US012601071B2

(12) United States Patent
Yoo et al.

(10) Patent No.: US 12,601,071 B2
(45) Date of Patent: Apr. 14, 2026

(54) METHOD FOR PREPARING METAL-CARBON COMPOSITE, METAL-CARBON COMPOSITE PREPARED USING THE METHOD, AND CATALYST FOR ELECTROLYTIC REACTION INCLUDING THE COMPOSITE

(71) Applicant: RESEARCH & BUSINESS FOUNDATION SUNGKYUNKWAN UNIVERSITY, Suwon-si (KR)

(72) Inventors: Pil Jin Yoo, Seoul (KR); Gwan Hyun Choi, Suwon-si (KR); Myeong Gyun Nam, Suwon-si (KR); Hyeon Jun Song, Suwon-si (KR)

(73) Assignee: RESEARCH & BUSINESS FOUNDATION SUNGKYUNKWAN UNIVERSITY, Suwon-si (KR)

( * ) Notice: Subject to any disclaimer, the term of this patent is extended or adjusted under 35 U.S.C. 154(b) by 756 days.

(21) Appl. No.: 17/960,201

(22) Filed: Oct. 5, 2022

(65) Prior Publication Data

US 2023/0116855 A1 Apr. 13, 2023

(30) Foreign Application Priority Data

Oct. 7, 2021 (KR) ..... 10-2021-0133036

(51) Int. Cl.
*C25B 11/054* (2021.01)
*C25B 11/065* (2021.01)
*C25B 11/089* (2021.01)

(52) U.S. Cl.
CPC ..... *C25B 11/054* (2021.01); *C25B 11/065* (2021.01); *C25B 11/089* (2021.01)

(58) Field of Classification Search
CPC ... C25B 11/054; C25B 11/089; C25B 11/065; B01J 20/226; B01J 31/1691
USPC ..... 502/183–185
See application file for complete search history.

(56) References Cited

U.S. PATENT DOCUMENTS

2017/0326536 A1* 11/2017 Jimoh ..... C07F 15/025
2021/0402369 A1* 12/2021 Shim ..... C09C 3/08

FOREIGN PATENT DOCUMENTS

KR 20070063185 A * 6/2007 ..... H01M 10/052
KR 20150061670 A * 6/2015 ..... B01J 37/08
KR 20170065075 A * 6/2017 ..... C01B 31/0226
KR 20210068245 A * 6/2021 ..... A61L 27/54
WO WO-2019243602 A1 * 12/2019 ..... B01J 20/28016
(Continued)

OTHER PUBLICATIONS

Junling Guo et al., "Engineering Multifunctional Capsules through the Assembly of Metal-Phenolic Networks." Angewandte Communications, vol. 53, pp. 5546-5551. (Year: 2014).*
(Continued)

*Primary Examiner* — Patricia L. Hailey
(74) *Attorney, Agent, or Firm* — LEX IP MEISTER, PLLC

(57) ABSTRACT

Disclosed is a method for preparing a metal-carbon composite. The method includes synthesizing a planarized ligand compound via planarization-modification of a polyphenol-based ligand compound; synthesizing a metal-organic composite via hydrothermal synthesis of a mixed solution of the planarized ligand compound and metal ions; drying the metal-organic composite to prepare precursor powders; and carbonizing the precursor powders.

15 Claims, 13 Drawing Sheets

(56) References Cited

FOREIGN PATENT DOCUMENTS

WO WO-2024025104 A1 * 2/2024 ..... H01M 4/02

OTHER PUBLICATIONS

Lin Hao et al., "Novel porous Fe3O4@C nanocomposite from magnetic metal-phenolic networks for the extraction of chlorophenols from environmental samples." Talanta 104, pp. 673-679. (Year: 2019).*

Naini Garg et al., "Metal-organic frameworks based nanostructure platforms for chemo-resistive sensing of gases." Coordination Chemistry Reviews 445, pp. 1-28. (Year: 2021).*

Xuechan Jiang et al., "Metal-organic framework derived carbon-based-sensor for monitoring of the oxidative stress of living cell and assessment of antioxidant activity of food extracts." Talanta 194, pp. 591-597. (Year: 2019).*

Qingtao Li et al., "Tannic acid-derived metal-phenolic networks facilitate PCL nanofiber mesh vascularization by promoting the adhesion and spreading of endothelial cells." Journal of Materials Chemistry B, 6, pp. 2734-2738. (Year: 2018).*

Jing Wei et al., "Hydrothermal Synthesis of Metal-Polyphenol Coordination Crystals and Their Derived Metal/N-doped Carbon Composites for Oxygen Electrocatalysis." Angewandte Chemie International Edition, vol. 55, Issue 40, p. 12470-12474. (Year: 2016).*

Gen Wang et al., "Nanoporous carbon spheres derived from metal-phenolic coordination polymers for supercapacitor and biosensor." Journal of Colloid and Interface Science 544, pp. 241-248. (Year: 2019).*

Liwei Yang et al., "Coating process and stability of metal-polyphenol film." Colloids and Surfaces A: Physicochemical and Engineering Aspects 484, pp. 197-205. (Year: 2015).*

Hirotaka Ejima et al., "One-Step Assembly of Coordination Complexes for Versatile Film and Particle Engineering." Science, vol. 341, pp. 154-157. (Year: 2013).*

* cited by examiner

METHOD FOR PREPARING METAL-CARBON COMPOSITE, METAL-CARBON COMPOSITE PREPARED USING THE METHOD, AND CATALYST FOR ELECTROLYTIC REACTION INCLUDING THE COMPOSITE

CROSS-REFERENCE TO RELATED APPLICATION

This application claims priority from Korean Patent Application No. 10-2021-0133036 filed on Oct. 7, 2021 in the Korean Intellectual Property Office, and all the benefits accruing therefrom under 35 U.S.C. 119, the contents of which in its entirety are herein incorporated by reference.

BACKGROUND

Field

The present disclosure relates to a method of preparing a metal-carbon composite using a polyphenol-based ligand compound, a metal-carbon composite prepared thereby, and a catalyst for an electrolytic reaction including the same.

Description of Related Art

In general, when a metal-carbon composite is prepared and is used as a catalyst material, a scheme of producing the composite via simple physical mixing of metal particles and carbon material or carbonizing a conventional metal-organic framework (MOF) is being tried.

When the metal-carbon composite is prepared via the simple physical mixing of the metal particles and carbon material, there is a problem of reduction in conductivity due to non-uniform mixing between the metal particles and carbon material or multiple contact resistances occurring at a bonding interface.

When the metal-organic framework (MOF) is directly carbonized, the composite is produced in a structure which both the metal and carbon are contained in the same base material, so that the above-mentioned contact resistance itself may be reduced. However, in this scheme, most of organic precursors ultimately derive amorphous carbon (Raman analysis D/G ratio>1.0) under a carbonization condition below 1000° C. such that the composite exhibits conductivity lower than that of crystalline carbon.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

One purpose according to the present disclosure is to provide a metal-carbon composite that may be used as a high-performance catalyst material for electrolytic reaction and a method for preparing the composite.

Another purpose of the present disclosure is to provide a catalyst for electrolytic reaction comprising the metal-carbon composite.

A first aspect of the present disclosure provides a method for preparing a metal-carbon composite, the method comprising: synthesizing a planarized ligand compound via planarization-modification of a polyphenol-based ligand compound; synthesizing a metal-organic composite via hydrothermal synthesis of a mixed solution of the planarized ligand compound and metal ions; drying the metal-organic composite to prepare precursor powders; and carbonizing the precursor powders.

In one implementation of the method, the polyphenol-based ligand compound includes at least one selected from a group consisting of compounds respectively represented by following Chemical Formulas;

[Chemical Formula 1-1]

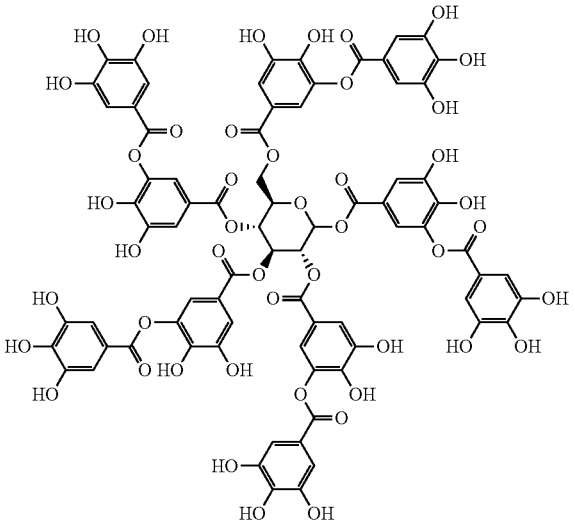

[Chemical Formula 1-2]

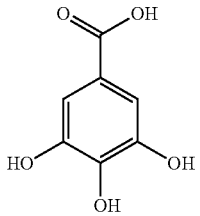

[Chemical Formula 1-3]

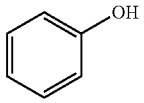

Phenl, mono-phenol

[Chemical Formula 1-4]

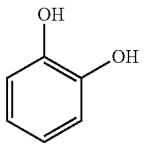

Catechol, di-phenol

[Chemical Formula 1-5]

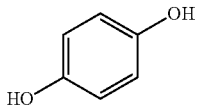

Hydroquinone, di-phenol

-continued

[Chemical Formula 1-6]

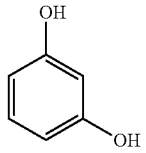

Resorcinol, di-phenol

[Chemical Formula 1-7]

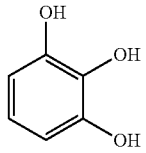

Gallocatechol, tri-phenol

[Chemical Formula 1-8]

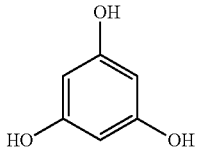

Phlorolglucinol, tri-phenol

[Chemical Formula 1-9]

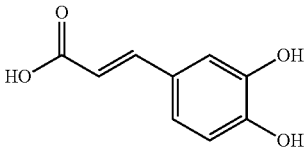

Caffeic acid

[Chemical Formula 1-10]

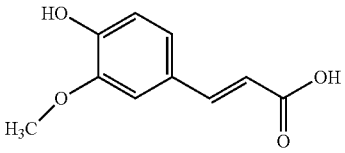

Ferulie acid

[Chemical Formula 1-11]

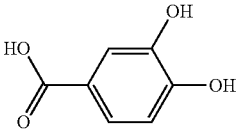

Protocatechuic acid

[Chemical Formula 1-12]

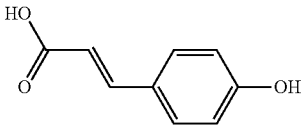

Coumaric acid

[Chemical Formula 1-13]

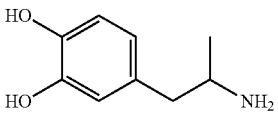

L-DOPA

-continued

[Chemical Formula 1-14]

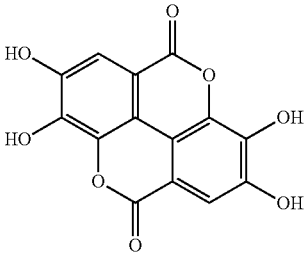

Ellagic acid

[Chemical Formula 1-15]

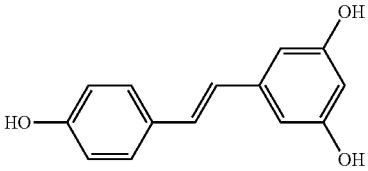

Resveratrol

[Chemical Formula 1-16]

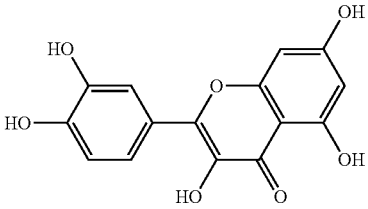

Quercetin

[Chemical Formula 1-17]

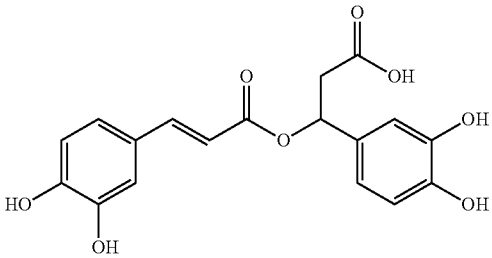

Rosmarinic acid

[Chemical Formula 1-18]

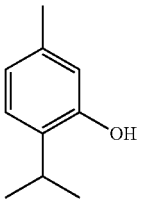

Thymol

[Chemical Formula 1-19]

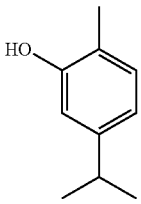

Carvacrol

[Chemical Formula 1-20]

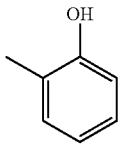

o-Cresol

[Chemical Formula 1-21]

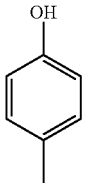

p-Cresol

[Chemical Formula 1-22]

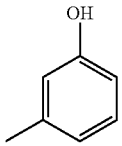

m-Cresol

[Chemical Formula 1-23]

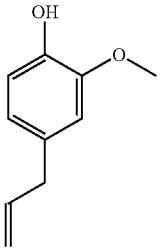

Eugenol

[Chemical Formula 1-24]

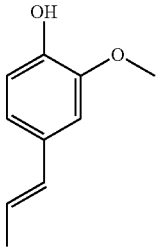

Isoeugenol

[Chemical Formula 1-25]

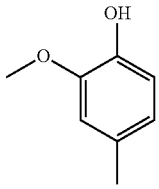

Cresol

-continued

[Chemical Formula 1-26]

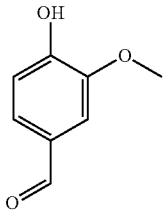

Vanillin

[Chemical Formula 1-27]

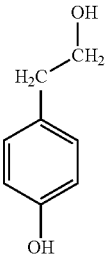

Tyrosol

[Chemical Formula 1-28]

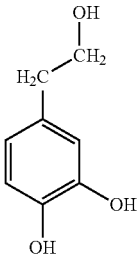

Hydroxytyrosol

[Chemical Formula 1-29]

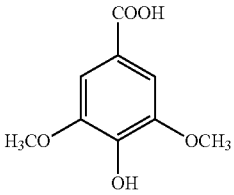

Syringic acid

[Chemical Formula 1-30]

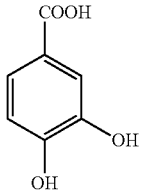

protocatechuic acid

[Chemical Formula 1-31]

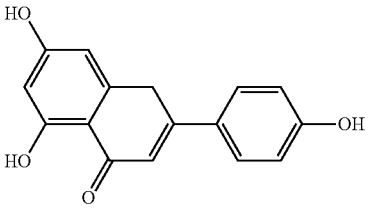

Apigenin

-continued
[Chemical Formula 1-32]
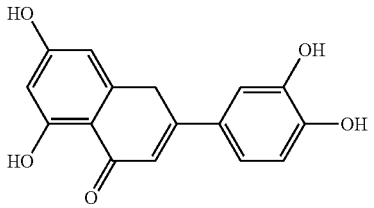
Luteolin
[Chemical Formula 1-33]
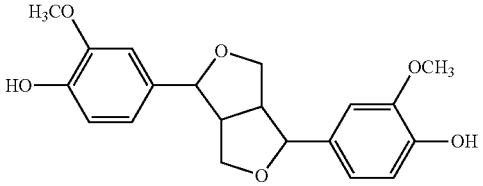
Pionoresinol
[Chemical Formula 1-34]
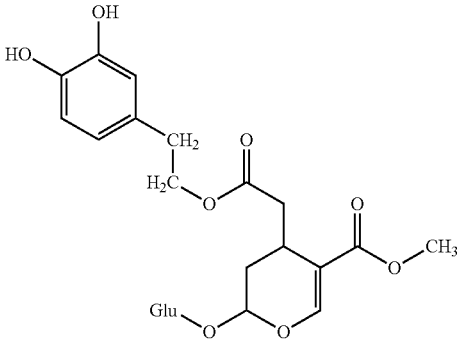
Olcuropcin
[Chemical Formula 1-35]
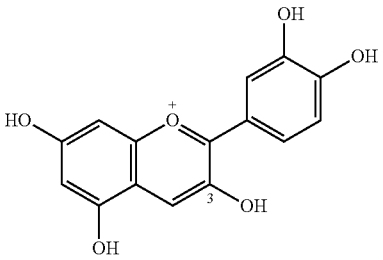
[Chemical Formula 1-36]
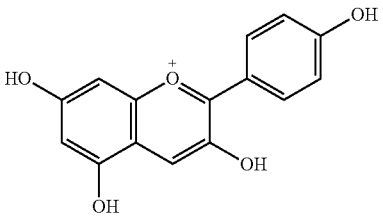
[Chemical Formula 1-37]
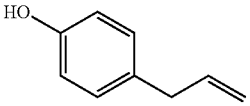
-continued
[Chemical Formula 1-38]
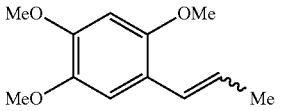
[Chemical Formula 1-39]
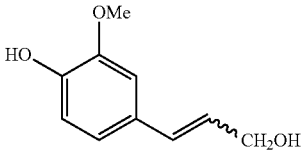
[Chemical Formula 1-40]
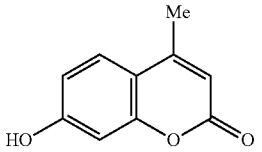
[Chemical Formula 1-41]
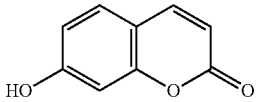
[Chemical Formula 1-42]
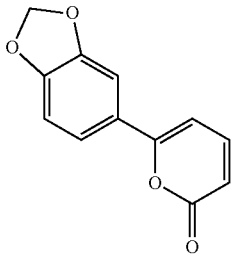
[Chemical Formula 1-43]
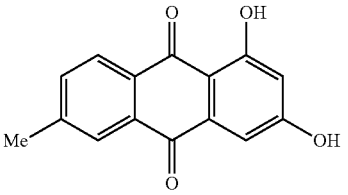
[Chemical Formula 1-44]
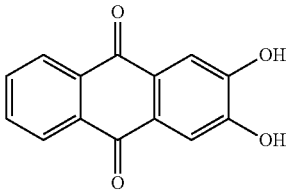
[Chemical Formula 1-45]
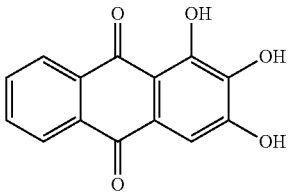

-continued
[Chemical Formula 1-46]
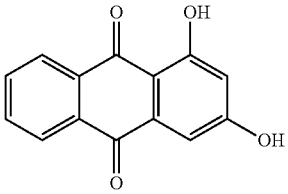
[Chemical Formula 1-47]
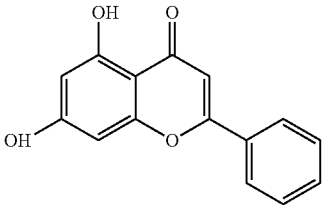
[Chemical Formula 1-48]
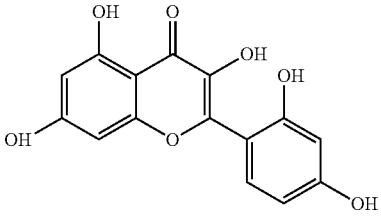
[Chemical Formula 1-49]
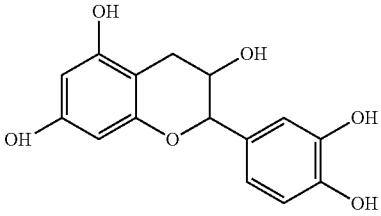
[Chemical Formula 1-50]
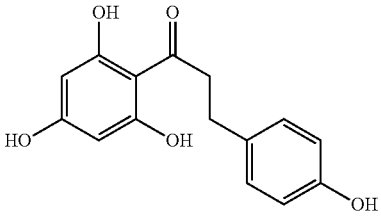
[Chemical Formula 1-51]
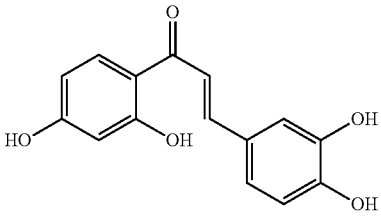
-continued
[Chemical Formula 1-52]
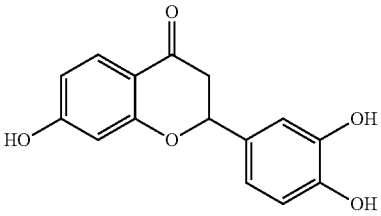
(a)
[Chemical Formula 1-53]
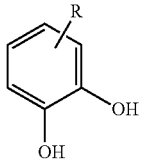
$R = R^{15,0}$, $R^{15,1}$, $R^{15,2}$ or $R^{15,3}$
(b)
[Chemical Formula 1-54]
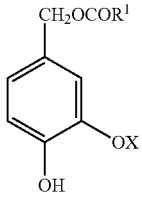
$R^1 = R^{17,2}$ or $R^{17,3}$
$X = H$ or $CH_3$
(c)
[Chemical Formula 1-55]
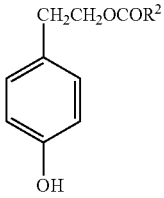
$R^2 = R^{17,2}$ or $R^{17,3}$
(d)
[Chemical Formula 1-56]
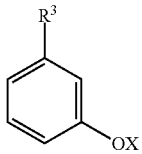
$R^3 = R^{15,0}$ (3%)
$R^{15,1}$ (34%)
$R^{15,2}$ (22%)
$R^{15,3}$ (41%)
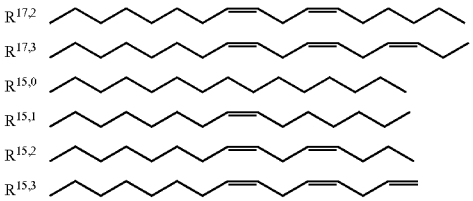

-continued

[Chemical Formula 1-57]

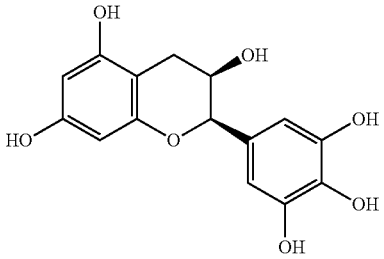

Epigallocatechin (EGC)

[Chemical Formula 1-58]

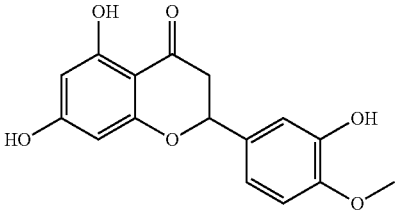

Hesperetin

[Chemical Formula 1-59]

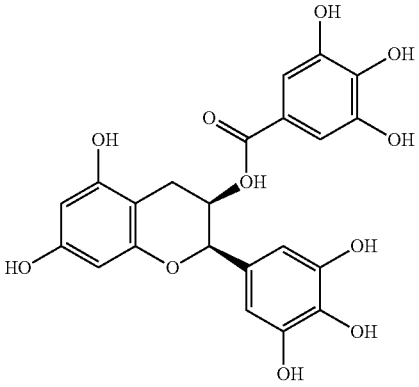

Epigallocatechin Gallate
(EGCG)

[Chemical Formula 1-60]

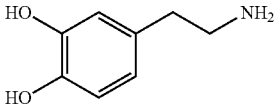

Dopamine

[Chemical Formula 1-61]

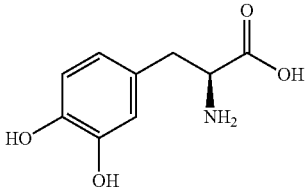

-continued

[Chemical Formula 1-62]

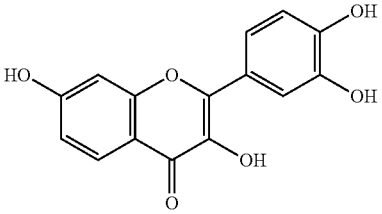

[Chemical Formula 1-63]

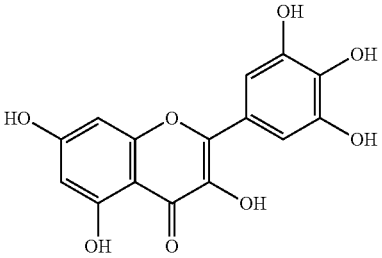

[Chemical Formula 1-64]

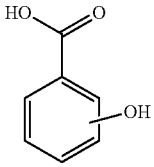

hydroxybenzoic acid

[Chemical Formula 1-65]

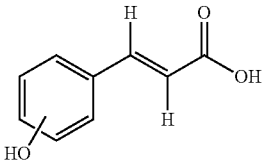

hydroxycinnamic acid

[Chemical Formula 1-66]

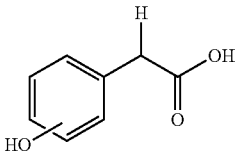

hydroxyphenylacetic acid

[Chemical Formula 1-67]

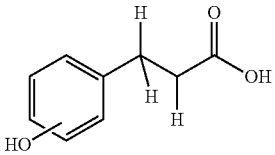

hydroxyphenylpropanoic acid

-continued

[Chemical Formula 1-68]

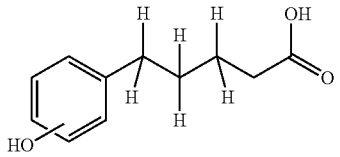

hydroxyphenylpentanoic acid

In one implementation of the method, synthesizing the planarized ligand compound includes: treating the polyphenol-based ligand compound with a basic substance to induce a C—C coupling reaction between phenol molecules to prepare an intermediate compound; and performing hydrothermal treatment of the intermediate compound to induce an esterification reaction.

In one implementation of the method, the planarized ligand compound has a plate-like structure.

In one implementation of the method, in the synthesizing of the metal-organic composite, the hydrothermal synthesis is performed at a temperature in a range of 100 to 200° C. for about 6 to 24 hours.

In one implementation of the method, a metal of the metal ion includes at least one selected from a group consisting of titanium, vanadium, chromium, manganese, iron, cobalt, nickel, copper, zinc, zirconium, molybdenum, ruthenium, rhodium, tin, lead, palladium, silver, gold, tungsten and platinum.

In one implementation of the method, in the synthesizing of the metal-organic composite, a molar ratio of the planarized ligand compound and the metal ions in the mixed solution is in a range of 1:0.01 to 100.

In one implementation of the method, in the synthesizing of the metal-organic composite, pH of the mixed solution is equal to or greater than 10.5.

In one implementation of the method, the carbonizing of the precursor powders is performed for about 30 minutes to 2 hours at a temperature in a range of 700 to 1300° C. under an inert gas atmosphere.

A second aspect of the present disclosure provides a metal-carbon composite prepared using the method as set forth above, wherein the metal-carbon composite comprises metal powders; and a crystalline carbon layer formed on a surface of the metal powders.

In one implementation of the metal-carbon composite, a metal of the metal powder includes a single metal or a metal alloy.

In one implementation of the metal-carbon composite, the metal of the metal powder includes one selected from a group consisting of titanium, vanadium, chromium, manganese, iron, cobalt, nickel, copper, zinc, zirconium, molybdenum, ruthenium, rhodium, tin, lead, palladium, silver, gold, tungsten and platinum or a metal alloy thereof.

In one implementation of the metal-carbon composite, a content of the crystalline carbon layer is in a range of 30 to 80 wt %, based on a total weight of the metal-carbon composite.

In one implementation of the metal-carbon composite, a size of the metal powder is in a range of about 10 to 200 nm.

In one implementation of the metal-carbon composite, the crystalline carbon layer has a thickness in a range of about 1 to 10 nm.

A third aspect of the present disclosure provides a catalyst for electrolytic reaction comprising the metal-carbon composite as set forth above.

According to the present disclosure, while a coating process such as expensive vapor deposition is not performed on metal particles, the crystalline carbon layer may be formed on the surface of the metal powders via the simple carbonization process of the metal-organic precursor having controlled orientation characteristics which may be produced via a coordination bond between the planarized ligand compound synthesized via the planarization process of the polyphenol-based molecules and the metal ions. Therefore, the metal-carbon composite according to the present disclosure including the crystalline carbon layer may have maximized conductivity due to effective electron transport ability, compared to the conventional metal-carbon composite prepared via the simple physical hybridization or using the general MOF.

Further, the metal-carbon composite according to the present disclosure includes the crystalline carbon layer with relatively strong resistance to oxidation/corrosion, etc., and thus may have high stability catalyst properties, compared to a composite containing general amorphous carbon that is vulnerable to oxidation. Therefore, when being used as a catalyst for an electrolytic reaction, the metal-carbon composite according to the present disclosure exhibits high current characteristics at the same voltage, and long-term working stability against the oxidation reaction.

In addition, the method according to the present disclosure may vary the ratio between the contents of the polyphenol-based ligand compound and the metal ions in the precursor to control the metal particle size or distribution of the metal-carbon composite.

Further, according to the present disclosure, the metal particles may be formed via a spontaneous alloying process using 5 or more types of metals. Thus, in order to maximize the characteristics of the catalyst for electrolytic reaction as applied later, a type of the metal particles or the metal alloy composition may be selectively controlled.

In addition to the effects as described above, specific effects in accordance with the present disclosure will be described together with the detailed description for carrying out the disclosure.

Figure 2:
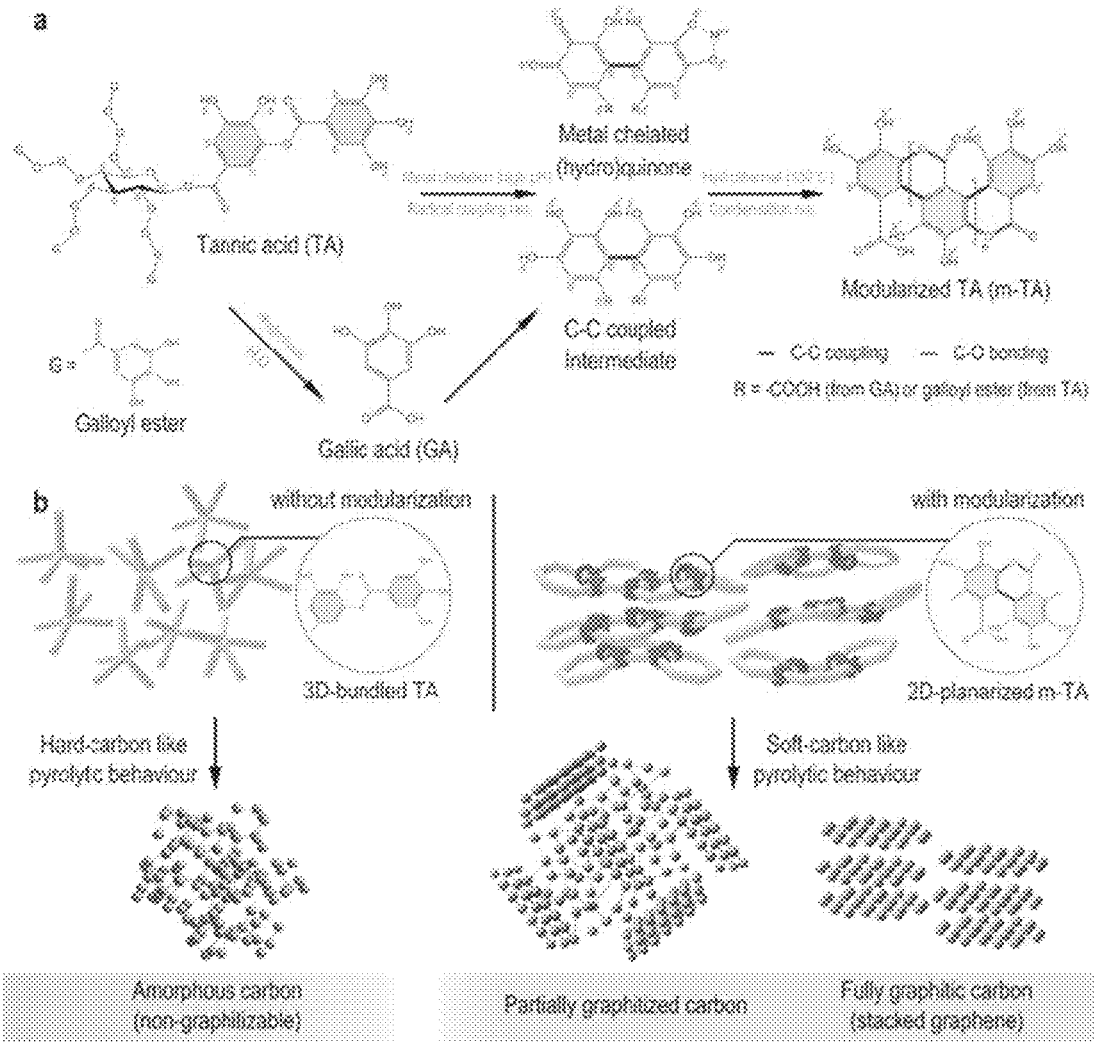

(a) in FIG. 2 is a diagram showing a planarization modifying reaction mechanism of a polyphenol-based ligand compound; (b) in FIG. 2 is a diagram showing a structural change after carbonization of a planarization-modified tannic acid molecule according to the present disclosure and a general tannic acid.

Figure 3:
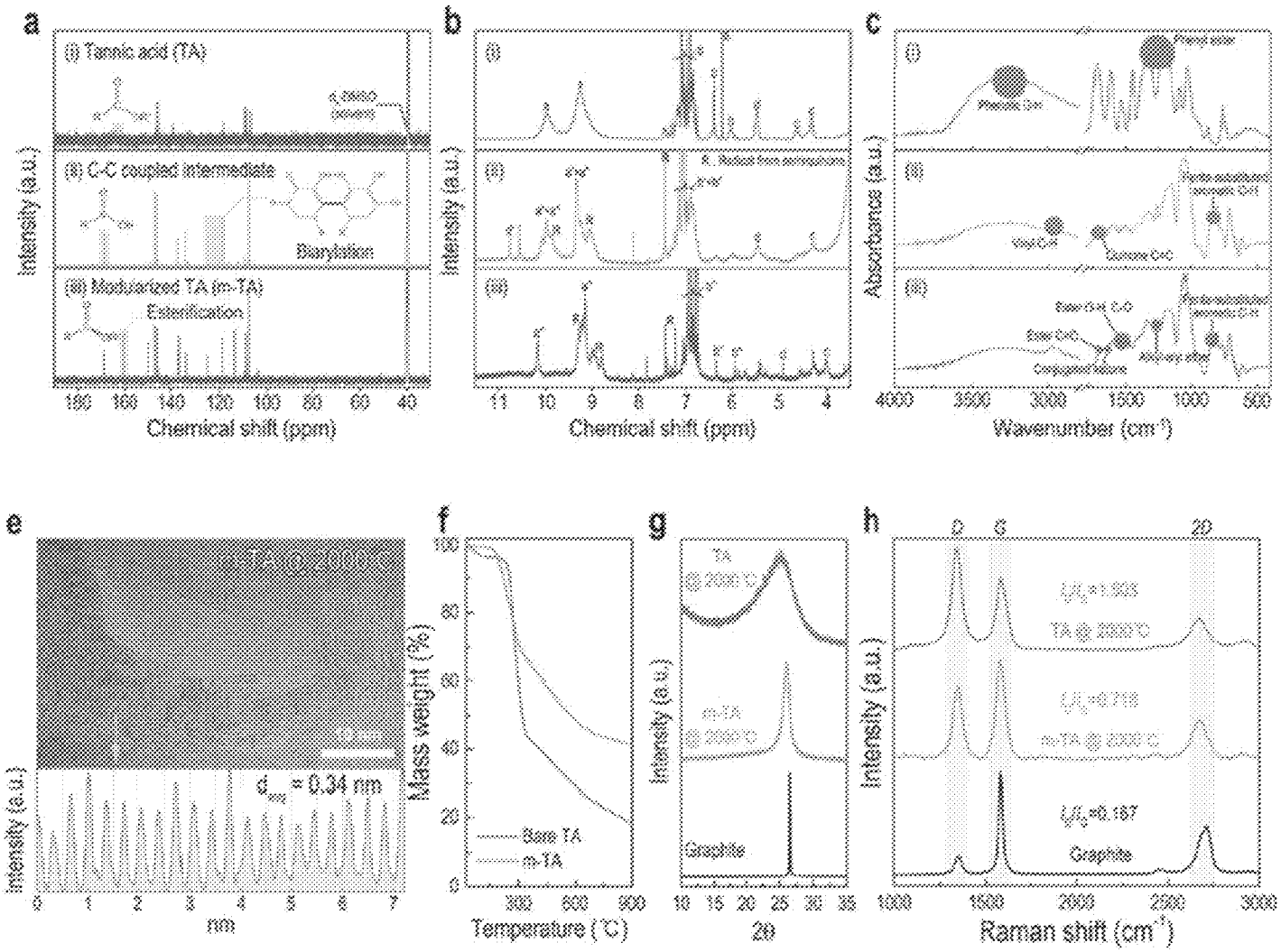

(a) to (c) in FIG. 3 show results of performing $^{13}C$ and $^{1}H$ nuclear magnetic resonance (NMR) and spectral characterization of FT-IR spectroscopy on reaction products (TA molecule (red), C—C coupled intermediate (orange), C—C and C—O coupled m-TA (green)) produced in a reaction mechanism step according to an embodiment of the present disclosure, respectively; (e) in FIG. 3 shows a TEM image after high-temperature carbonization of a planarized ligand compound; and (f) to (g) in FIG. 3 show a thermogravimetric analysis result, an XRD analysis result, and a Raman spectrum of each of the planarized ligand compound and Comparative Example.

Figure 4:
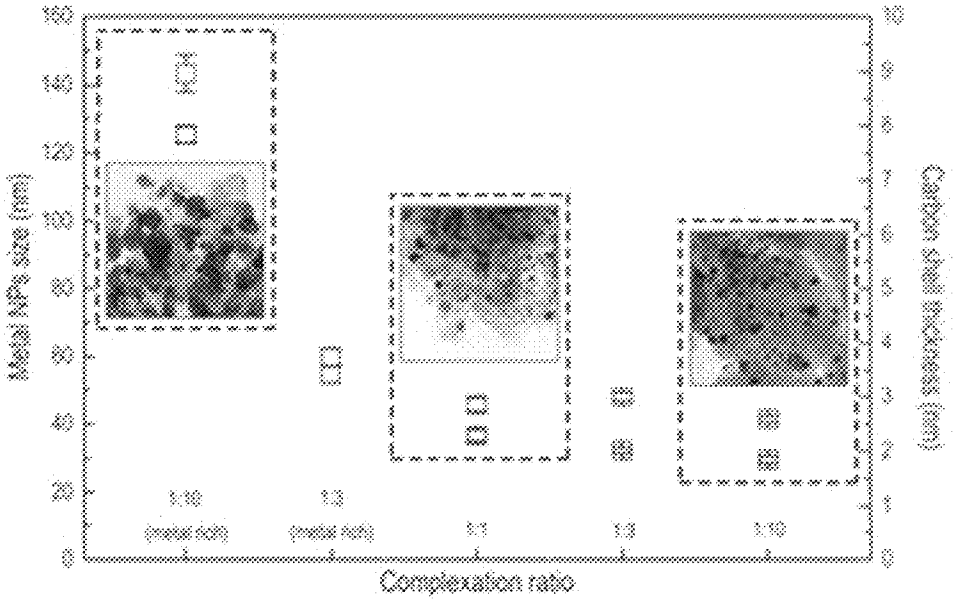
Figure 4:
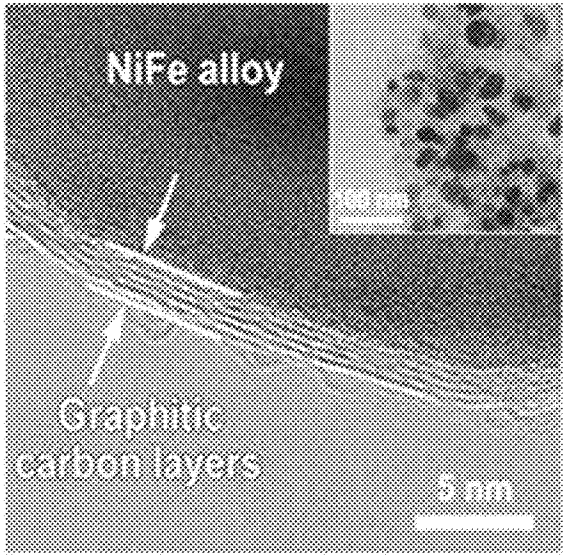
Figure 5:
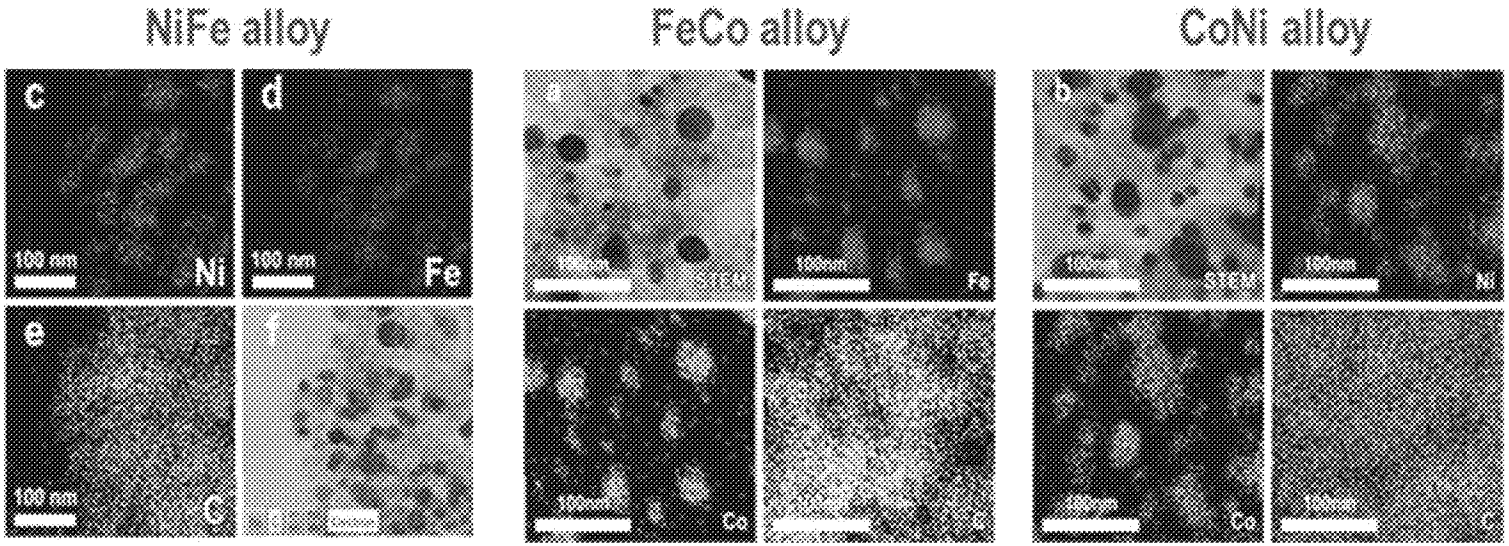

FIGS. 4 and 5 show a TEM image and an EDS mapping image of a metal-carbon composite containing a bimetallic alloy containing two metals among Fe, Co and Ni, and show a metal particle size and a carbon layer thickness based on a molar ratio of the metal and the planarized ligand compound.

Figure 6:
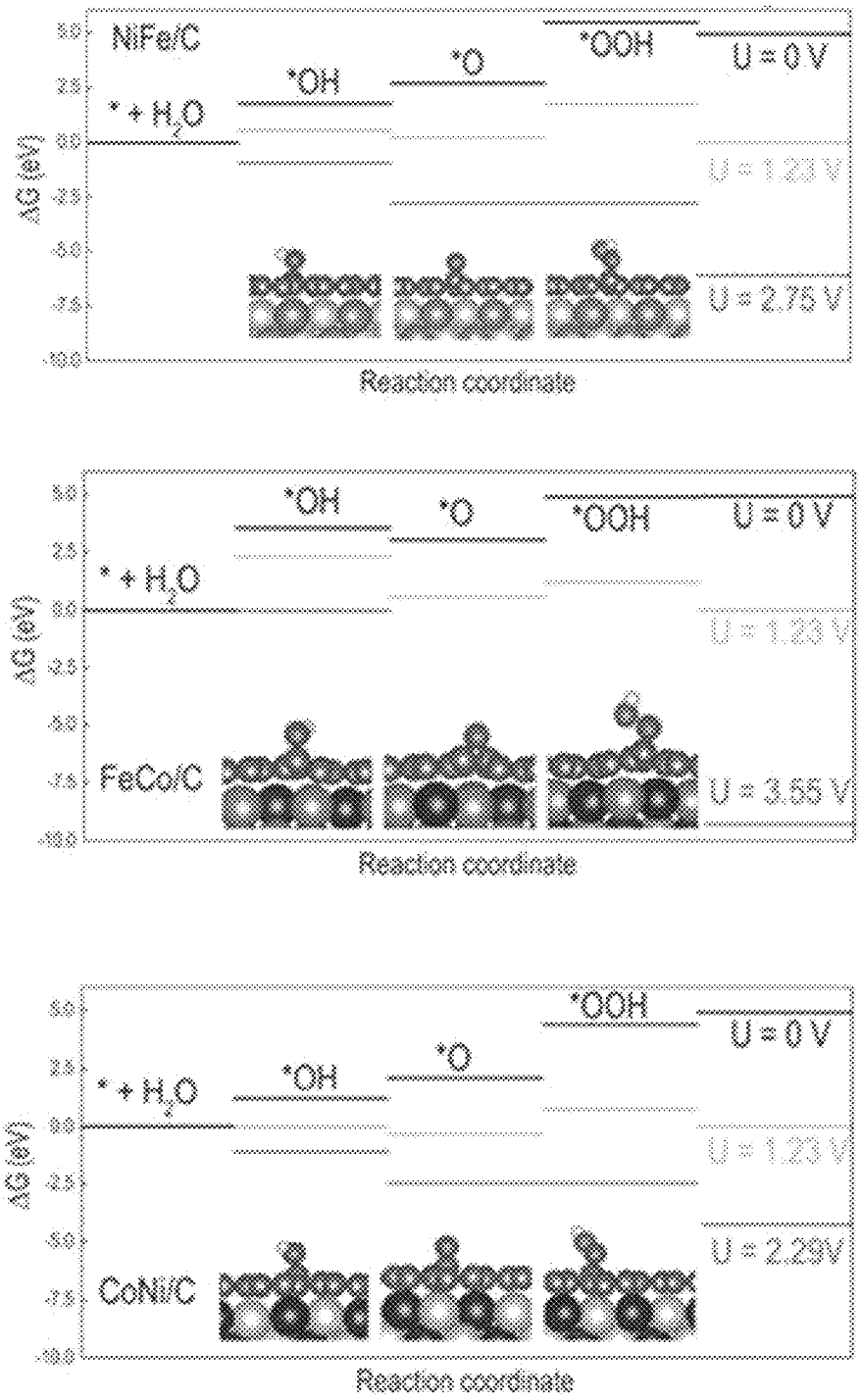

FIG. 6 shows a Gibbs free energy profile of each of NiFe/C catalyst, FeCo/C catalyst, and CoNi/C catalyst on each reaction intermediate during OER at different constant potentials.

Figure 7:
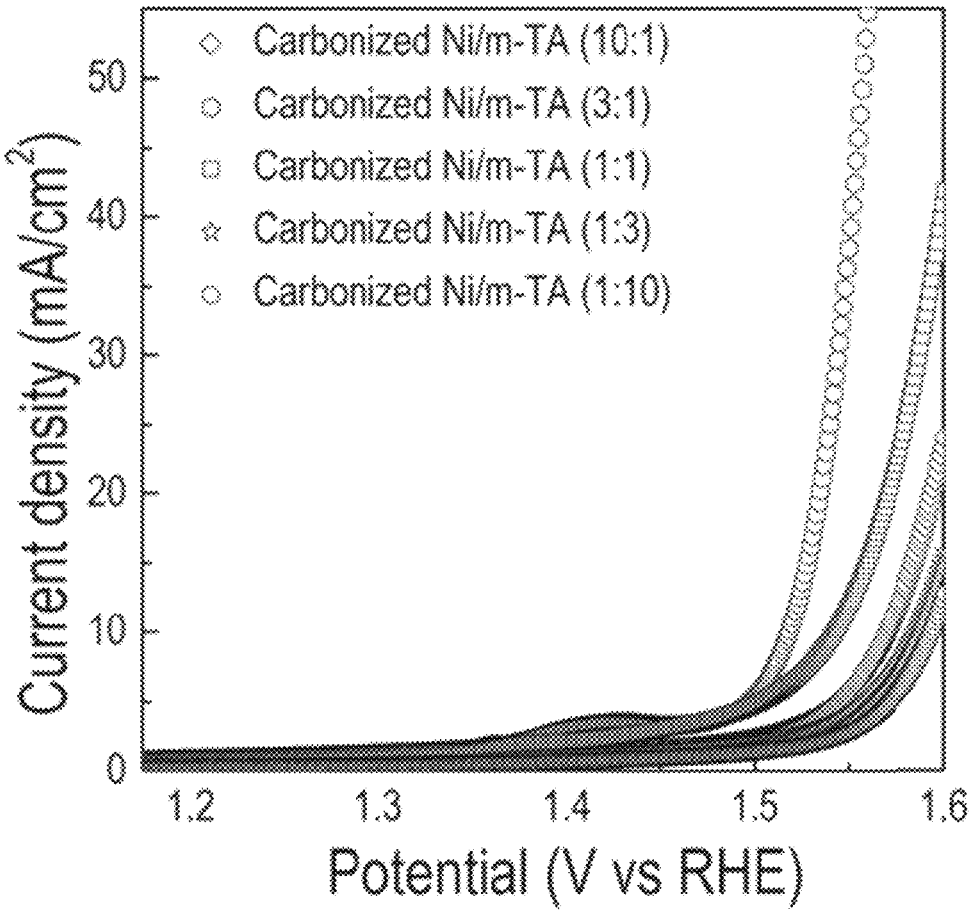

FIG. 7 shows a measurement result based on a LSV (Linear Sweep Voltammetry) as an oxygen evolution reaction test result of a metal/carbon composite according to the present disclosure based on a molar ratio of a metal and a planarized ligand compound.

Figure 8:
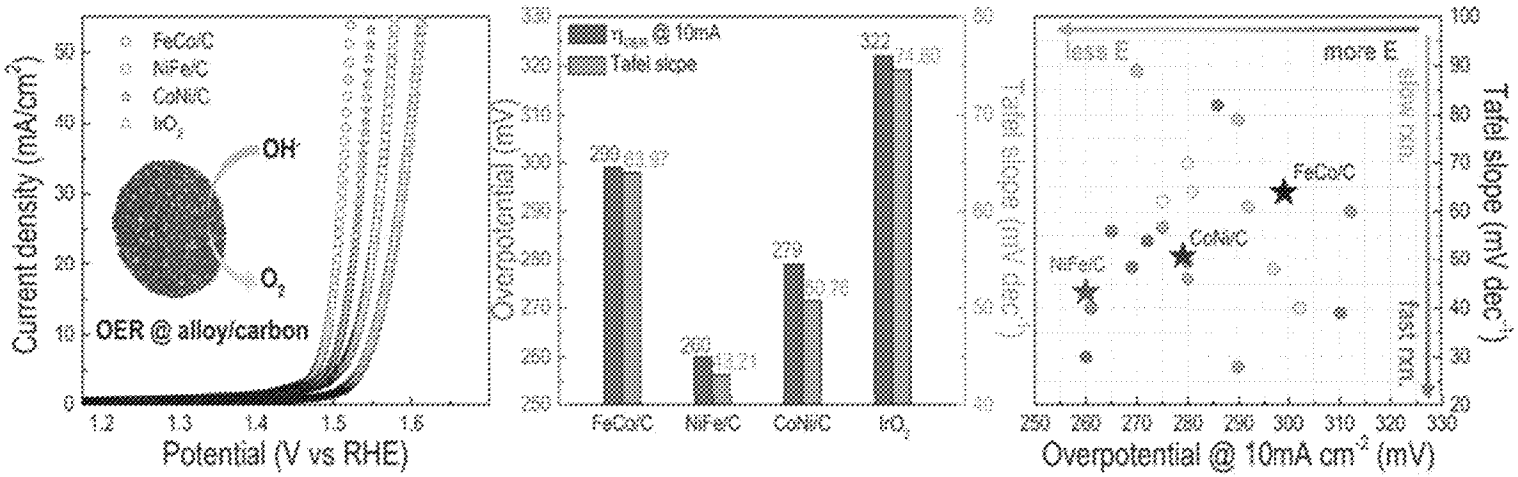

FIG. 8 shows a measurement result (left) based on the LSV (Linear Sweep Voltammetry), an overpotential/Tafel slope comparison (middle), and an overpotential/Tafel slope comparison schematic diagram (right) compared with other references, as an oxygen evolution reaction test result of a bimetallic alloy/carbon composite synthesized according to an embodiment of the present disclosure.

Figure 9:
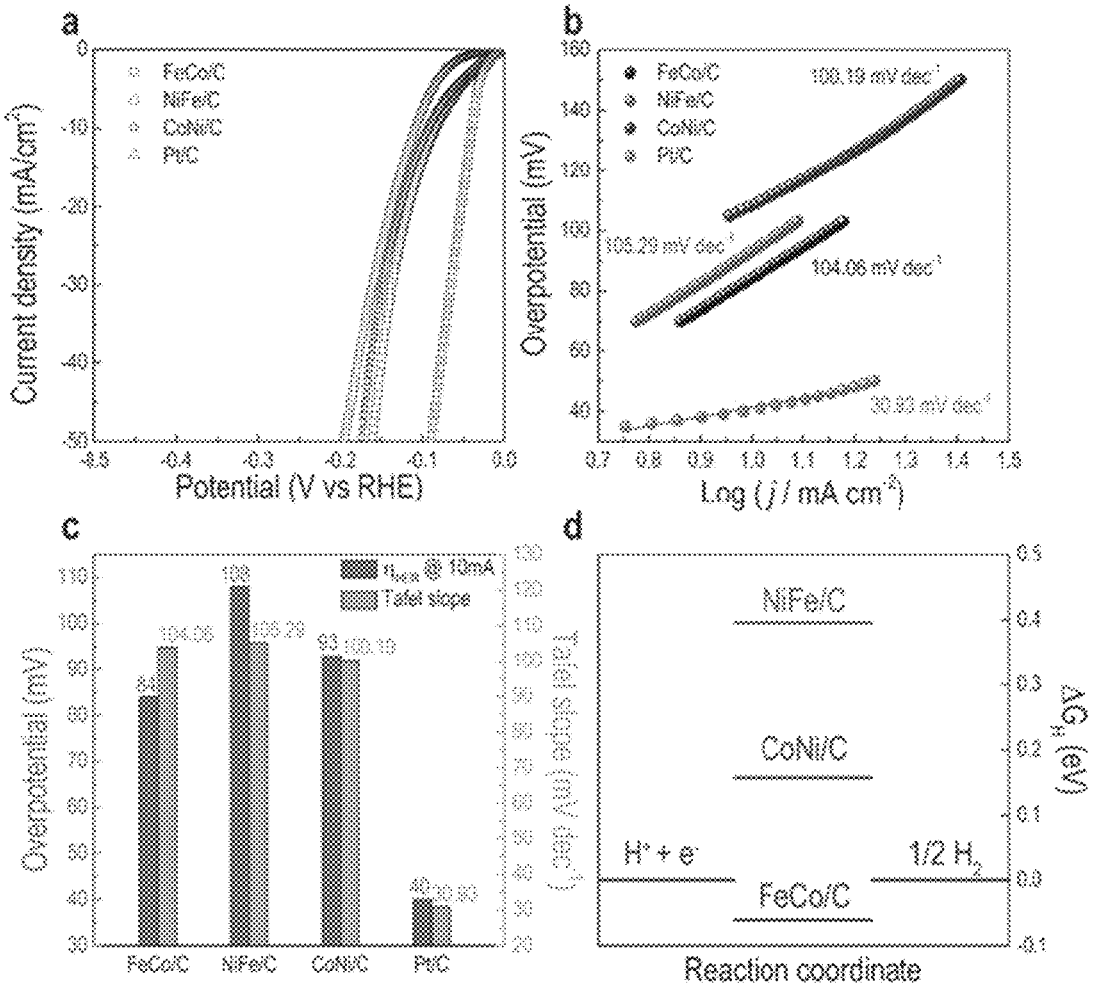

FIG. 9 shows a measurement result (top left) based on the LSV (Linear Sweep Voltammetry), a Tafel schematic diagram (top right), an overpotential and Tafel slope comparison (bottom left), and a comparison schematic diagram of a theoretical adsorption energy of hydrogen ions (bottom right) as a hydrogen evolution reaction test result of a bimetallic alloy/carbon composite synthesized according to an embodiment of the present disclosure.

Figure 10:
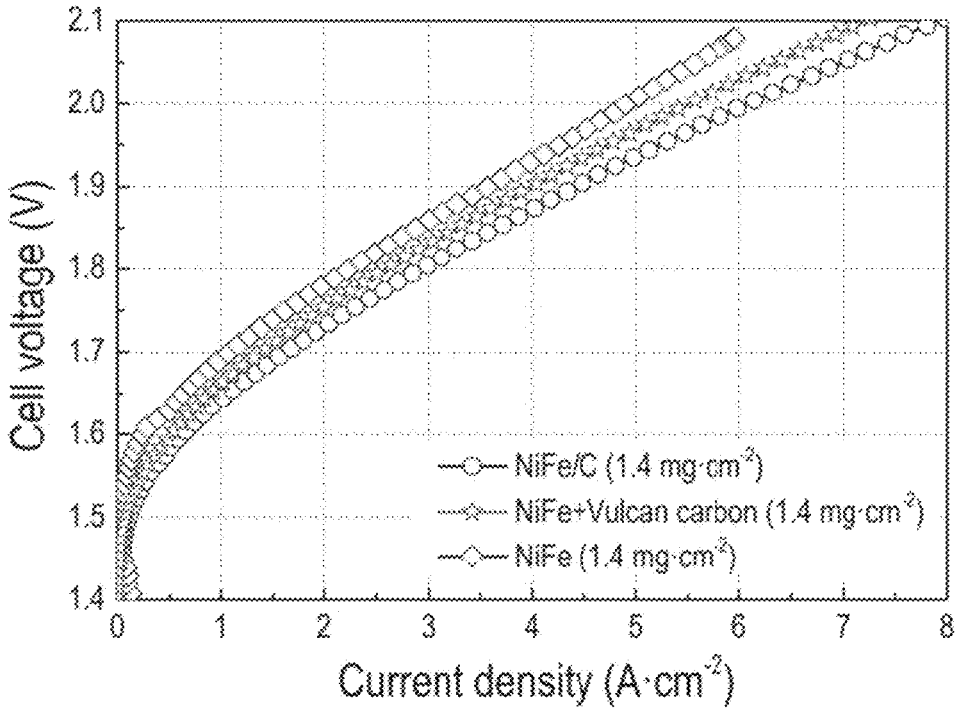

FIG. 10 is a graph showing performance measurement of an alkaline anion exchange membrane water electrolyzer in which a metal-carbon composite according to the present disclosure is applied as an anode of the alkaline anion exchange membrane water electrolyzer.

Figure 11:
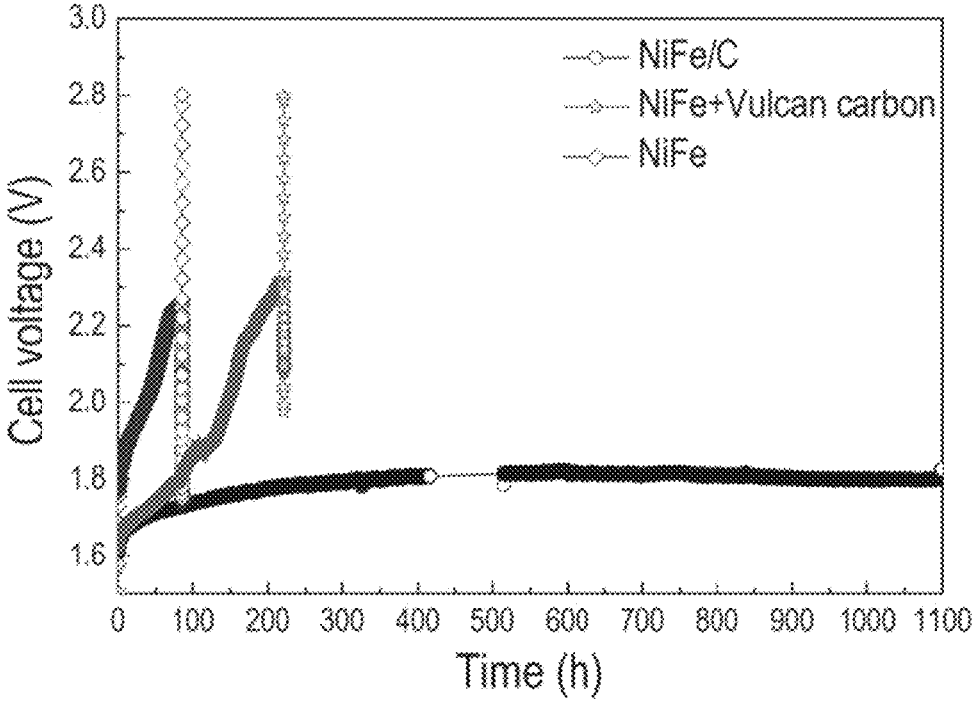

FIG. 11 is a graph illustrating long-term operation stability of an alkaline anion exchange membrane water electrolyzer in which a NiFe/C composite synthesized in accordance with the present disclosure is applied as an anode of the alkaline anion exchange membrane water electrolyzer.

Figure 12A:
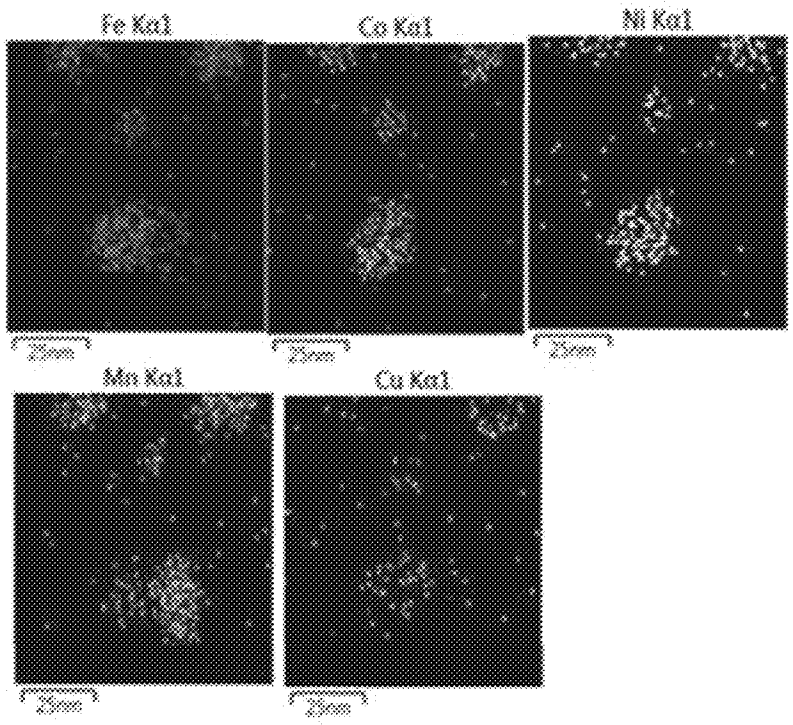
Figure 12A:
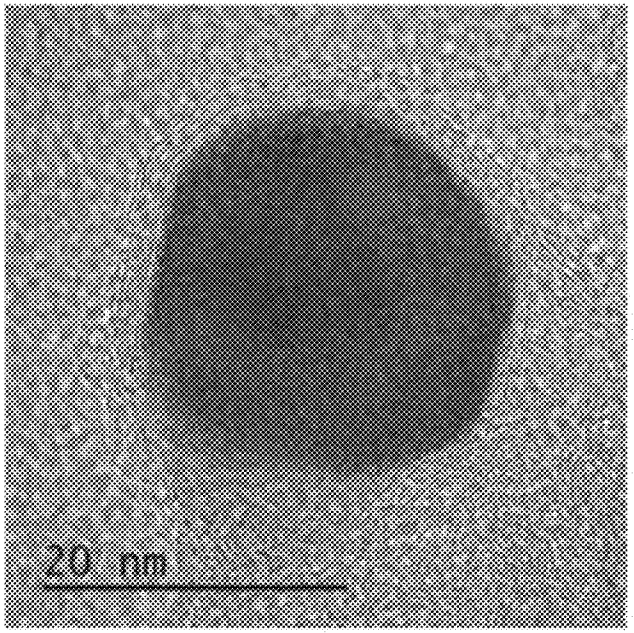

FIG. 12A shows a TEM image and an EDS mapping image of a metal-carbon composite containing a five metal alloy composed of Fe, Co, Ni, Mn and Cu.

Figure 12B:
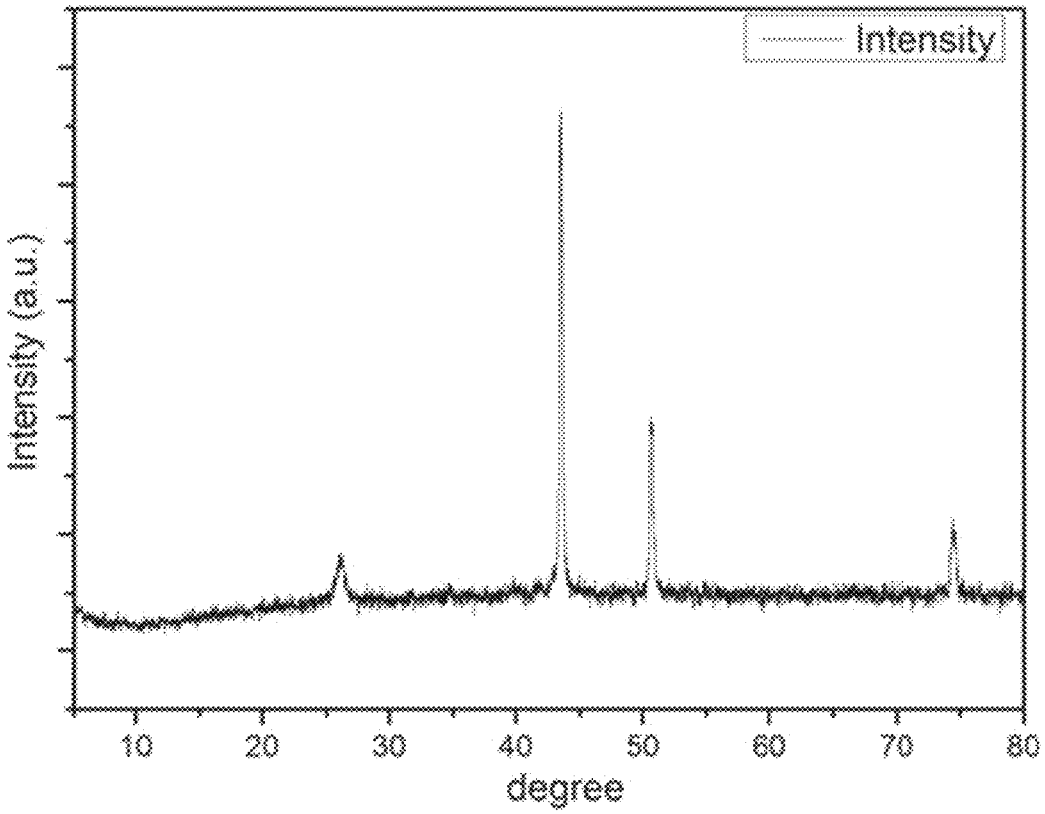

FIG. 12B shows an XRD data of a metal-carbon composite containing a five metal alloy composed of Fe, Co, Ni, Mn and Cu.

DETAILED DESCRIPTIONS

For simplicity and clarity of illustration, elements in the figures are not necessarily drawn to scale. The same reference numbers in different figures represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

A shape, a size, a ratio, an angle, a number, etc. disclosed in the drawings for illustrating embodiments of the present disclosure are illustrative, and the present disclosure is not limited thereto. The same reference numerals refer to the same elements herein. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

The terminology used herein is for the purpose of describing particular embodiments only and is not intended to limit the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entirety of list of elements and may not modify the individual elements of the list. When referring to "C to D", this means C inclusive to D inclusive unless otherwise specified.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In one example, when a certain embodiment may be implemented differently, a function or operation specified in a specific block may occur in a sequence different from that specified in a flowchart. For example, two consecutive blocks may actually be executed at the same time. Depending on a related function or operation, the blocks may be executed in a reverse sequence.

In descriptions of temporal relationships, for example, temporal precedent relationships between two events such as "after", "subsequent to", "before", etc., another event may occur therebetween unless "directly after", "directly subsequent" or "directly before" is not indicated.

The features of the various embodiments of the present disclosure may be partially or entirely combined with each other, and may be technically associated with each other or operate with each other. The embodiments may be implemented independently of each other and may be implemented together in an association relationship.

Figure 1:
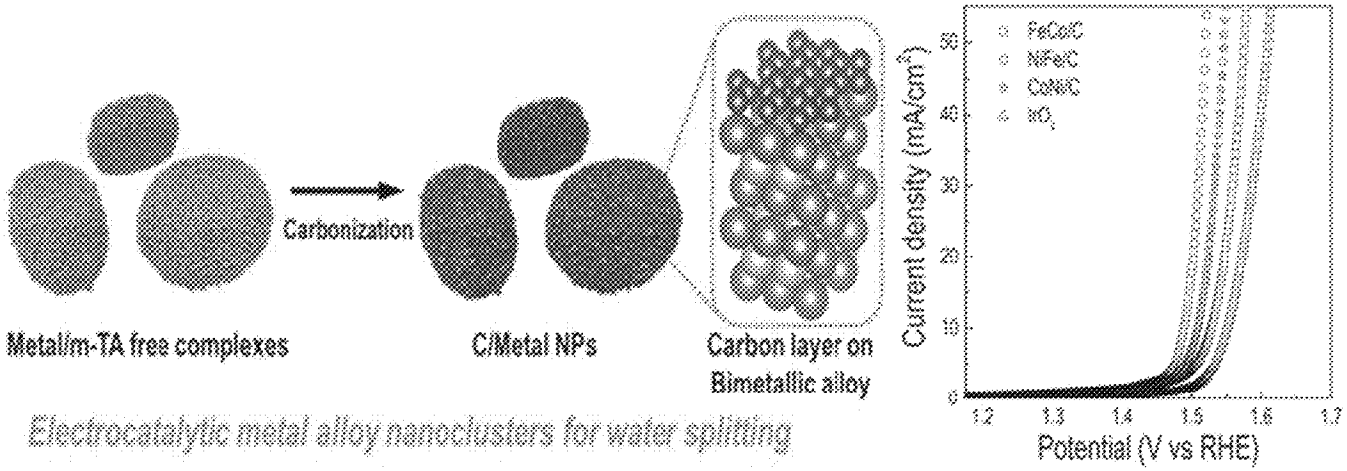
FIG. 1 is a schematic diagram showing a method for preparing a metal-carbon composite according to an embodiment of the present disclosure.

FIG. 1 is a schematic diagram showing a method for preparing a metal-carbon composite according to an embodiment of the present disclosure.

Referring to FIG. 1, the method for preparing the metal-carbon composite according to an embodiment of the present disclosure includes synthesizing a planarized ligand compound via planarization-modification of a polyphenol-based ligand compound (S100), synthesizing a metal-organic composite via hydrothermal synthesis of a mixed solution of the planarized ligand compound and metal ions (S200), preparing precursor powders via drying of the metal-organic composite (S300), and carbonizing the precursor powders (S400).

In S100, the method may synthesize the planarized ligand compound via planarization-modifying of various polyphenol-based ligand compounds containing catechol and a large number of galloyl groups. The planarized ligand compound and the metal ions may constitute a solution phase coordination compound in S200.

In one embodiment, the polyphenol-based ligand compound is not particularly limited, but may be represented by one or more selected from following Chemical Formulas, and may preferably include a tannic acid represented by Chemical Formula 1-1.

[Chemical Formula 1-1]

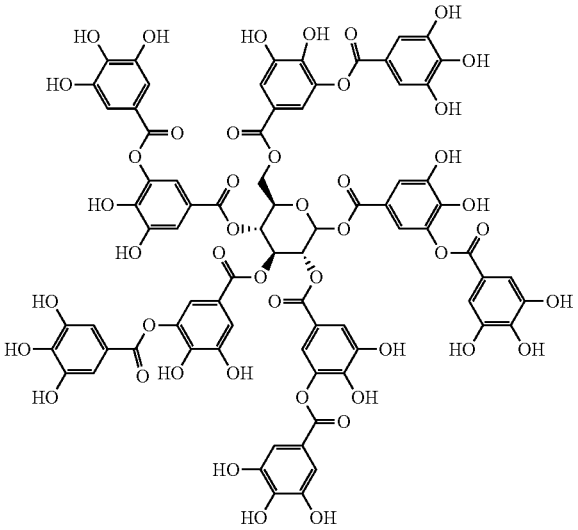

[Chemical Formula 1-2]

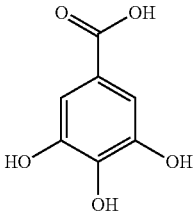

[Chemical Formula 1-3]

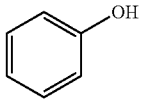

Phenol, mono-phenol

[Chemical Formula 1-4]

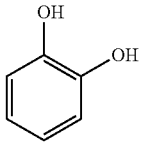

Catechol, di-phenol

-continued

[Chemical Formula 1-5]

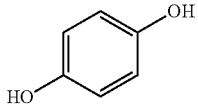

Hydroquinone, di-phenol

[Chemical Formula 1-6]

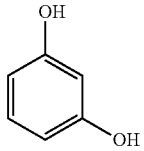

Resorcinol, di-phenol

[Chemical Formula 1-7]

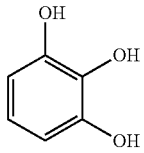

Gallocatechol, tri-phenol

[Chemical Formula 1-8]

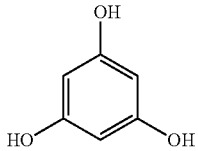

Phloroglucinol, tri-phenol

[Chemical Formula 1-9]

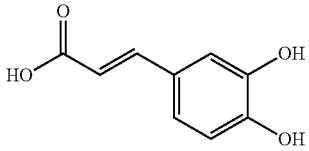

Caffeic acid

[Chemical Formula 1-10]

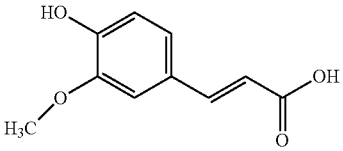

Ferulic acid

[Chemical Formula 1-11]

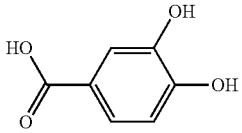

Protocatechuic acid

[Chemical Formula 1-12]

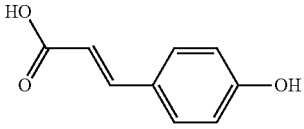

Coumaric acid

[Chemical Formula 1-13]

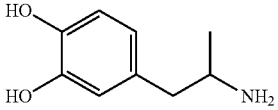

L-DOPA

-continued

[Chemical Formula 1-14]

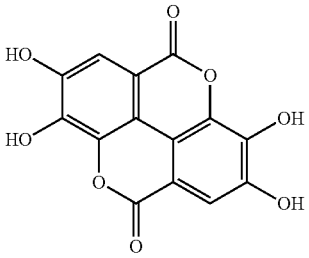

Ellagic acid

[Chemical Formula 1-15]

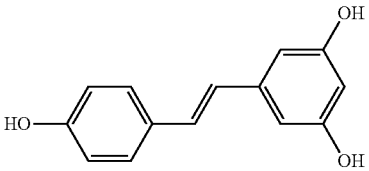

Resveratrol

[Chemical Formula 1-16]

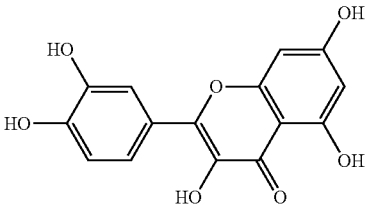

Quercetin

[Chemical Formula 1-17]

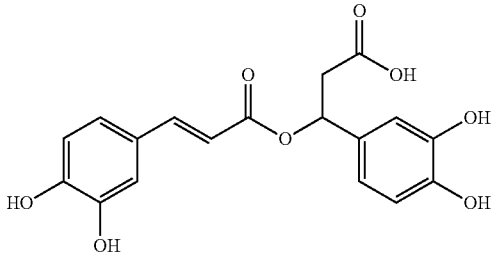

Rosmarinic acid

[Chemical Formula 1-18]

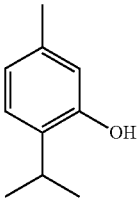

Thymol

[Chemical Formula 1-19]

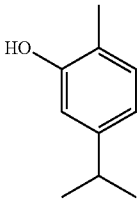

Carvacrol

-continued

[Chemical Formula 1-20]

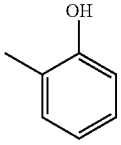

o-Cresol

[Chemical Formula 1-21]

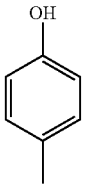

p-Cresol

[Chemical Formula 1-22]

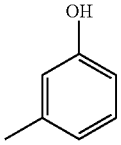

m-Cresol

[Chemical Formula 1-23]

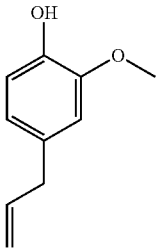

Eugenol

[Chemical Formula 1-24]

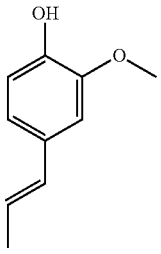

Isoeugenol

[Chemical Formula 1-25]

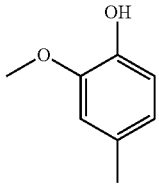

Creosol

-continued
[Chemical Formula 1-26]
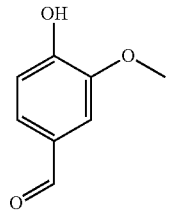
Vanillin
[Chemical Formula 1-27]
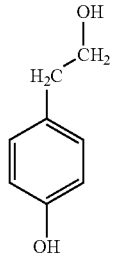
Tyrosol
[Chemical Formula 1-28]
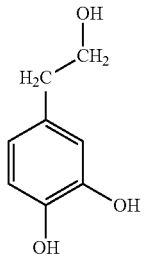
Hyroxytyrosol
[Chemical Formula 1-29]
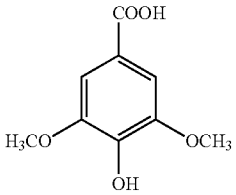
Syringic acid
[Chemical Formula 1-30]
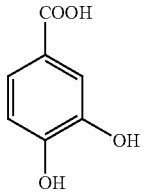
protocatechuic acid
[Chemical Formula 1-31]
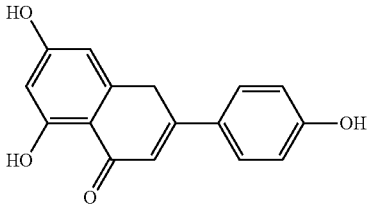
Apigenin
-continued
[Chemical Formula 1-32]
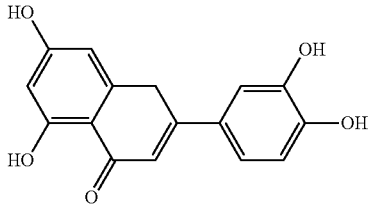
Luteolin
[Chemical Formula 1-33]
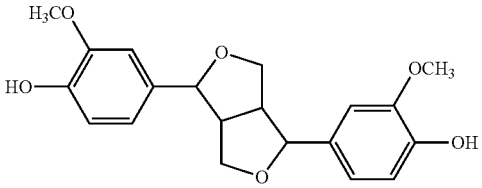
Pionoresinol
[Chemical Formula 1-34]
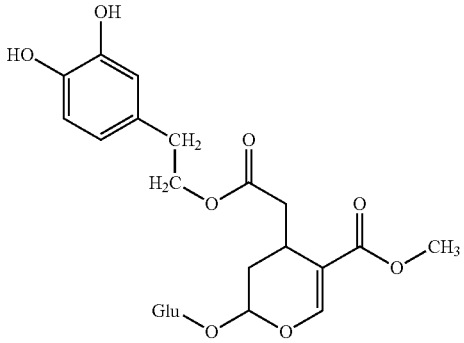
Olcuropcin
[Chemical Formula 1-35]
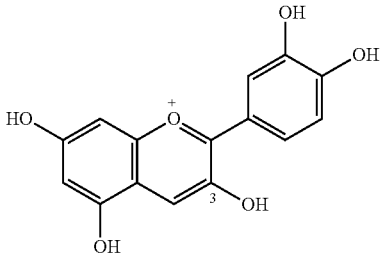
[Chemical Formula 1-36]
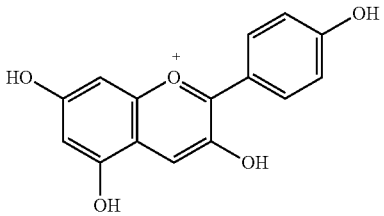
[Chemical Formula 1-37]
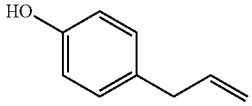

-continued
[Chemical Formula 1-38]
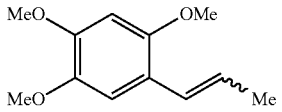
[Chemical Formula 1-39]
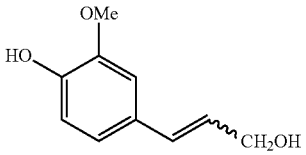
[Chemical Formula 1-40]
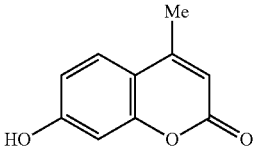
[Chemical Formula 1-41]
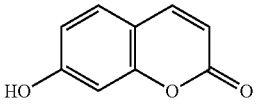
[Chemical Formula 1-42]
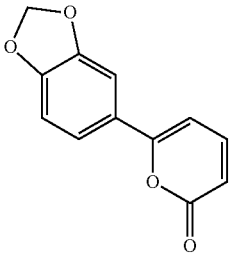
[Chemical Formula 1-43]
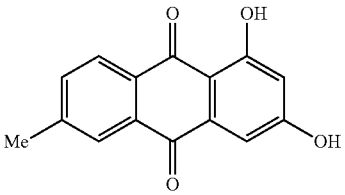
[Chemical Formula 1-44]
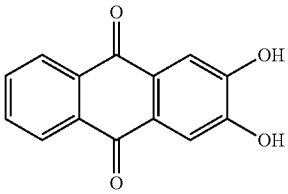
[Chemical Formula 1-45]
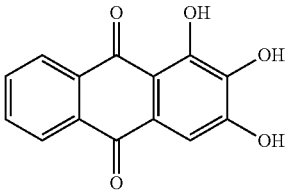
[Chemical Formula 1-46]
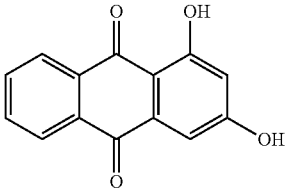
-continued
[Chemical Formula 1-47]
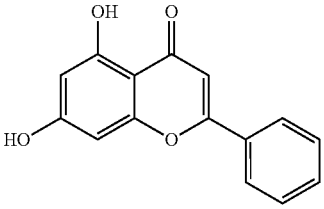
[Chemical Formula 1-48]
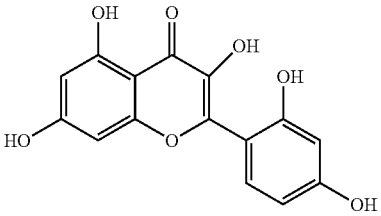
[Chemical Formula 1-49]
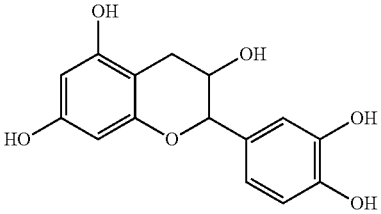
[Chemical Formula 1-50]
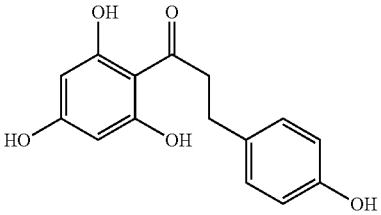
[Chemical Formula 1-51]
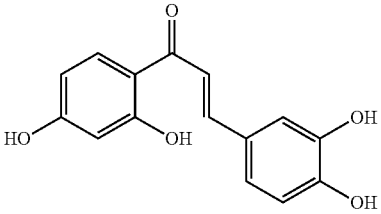
[Chemical Formula 1-52]
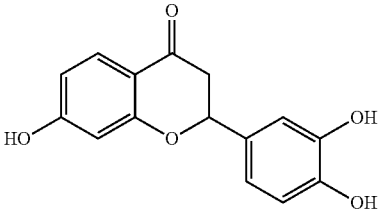

-continued
(a)
[Chemical Formula 1-53]
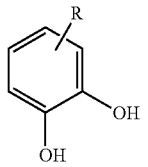
$R = R^{15,0}, R^{15,1}, R^{15,2}$ or $R^{15,3}$
(b)
[Chemical Formula 1-54]
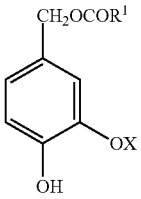
$R^1 = R^{17.2}$ or $R^{17.3}$
$X = H$ or $CH_3$
(c)
[Chemical Formula 1-55]
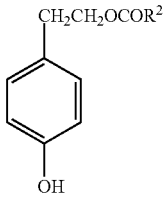
$R^2 = R^{17.2}$ or $R^{17.3}$
(d)
[Chemical Formula 1-56]
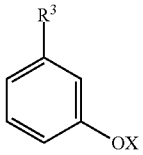
$R^3 =$ $R^{15.0}$ (3%)
$R^{15.1}$ (34%)
$R^{15.2}$ (22%)
$R^{15.3}$ (41%)
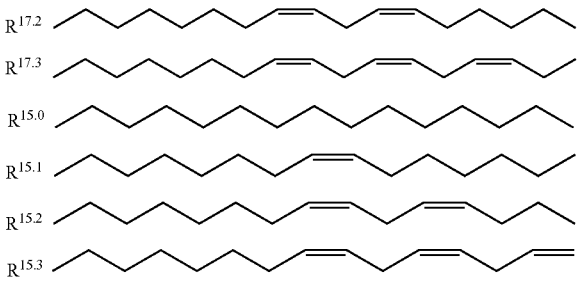
-continued
[Chemical Formula 1-57]
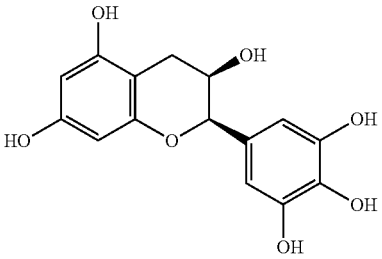
Epigallocatechin (EGC)
[Chemical Formula 1-58]
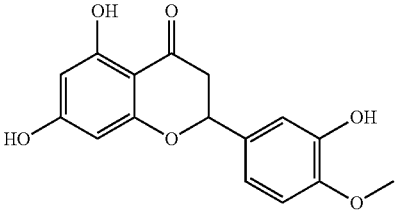
Hesperetin
[Chemical Formula 1-59]
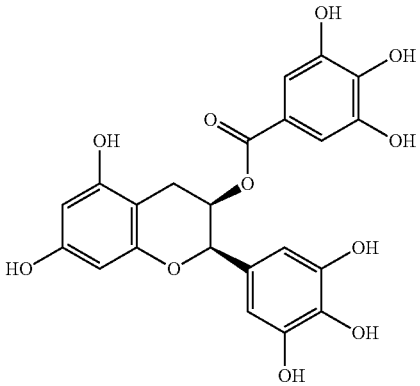
Epigallocatechin Gallate
(EGCG)
[Chemical Formula 1-60]
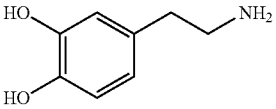
Dopamine
[Chemical Formula 1-61]
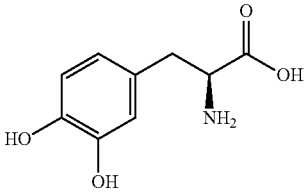

-continued

[Chemical Formula 1-62]

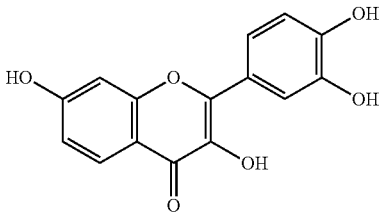

[Chemical Formula 1-63]

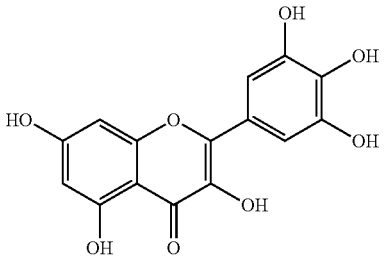

[Chemical Formula 1-64]

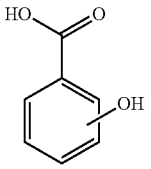

hydroxybenzoic acid

[Chemical Formula 1-65]

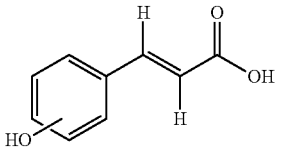

hydroxycinnamic acid

[Chemical Formula 1-66]

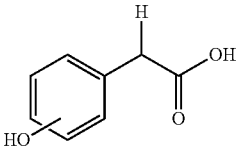

hydroxyphenylacetic acid

[Chemical Formula 1-67]

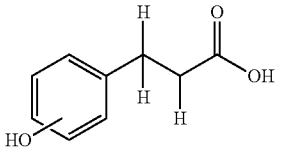

hydroxyphenylpropanoic acid

[Chemical Formula 1-68]

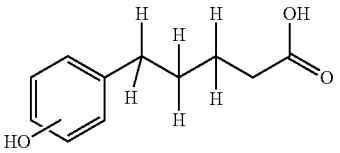

hydroxyphenylpentanoic acid

In one implementation of the method, synthesizing the planarized ligand compound (S100) includes: treating the polyphenol-based ligand compound with a basic substance to induce a C—C coupling reaction between phenol molecules to prepare an intermediate compound; and performing hydrothermal treatment of the intermediate compound to induce an esterification reaction.

Specifically, referring to (a) in FIG. 2, the planarization modifying reaction (modular knitting process) may proceed as two successive reactions.

In one embodiment, the polyphenol-based ligand compound (tannic acid) is hydrolyzed under a basic condition of pH 10.5 and is dissociated into smaller units including gallic acid (GA). At the same time, these dissociated galloyl groups (galloyl esters) is subjected to oxidative crosslinking at the same pH to induce an additional C—C coupling reaction in the hydrolyzed intermediate compound.

Thereafter, the hydrothermal treatment is performed at about 180° C., hydroxyl and carboxyl groups of a galloyl unit are activated to induce an esterification reaction.

In this way, C—C coupling and C—O coupling may occur continuously, such that the planarization-modification of the polyphenol-based ligand compound may proceed. In this regard, the planarized ligand compound may have a plate-like structure.

In S200, the coordination bond between the planarized ligand compound and the metal ions is achieved to produce the metal-organic composite (metal-organic compound). In S200, the hydrothermal synthesis is preferably performed at a temperature in a range of 100 to 200° C. for 6 to 24 hours.

In one embodiment, a metal of the metal ion may be a transition metal, for example, at least one selected from titanium, vanadium, chromium, manganese, iron, cobalt, nickel, copper, zinc, zirconium, molybdenum, ruthenium, rhodium, tin, lead, palladium, silver, gold, tungsten, and platinum. In this regard, the type of the metal of the metal ion is not particularly limited because metal particles may be formed via a spontaneous alloying process during the carbonization even using 5 or more types of metal ions.

In one example, the method according to the present disclosure may variously controlling the molar ratio of the planarized ligand compound and the metal ion in the mixed solution to control the metal particle size or distribution of the metal-carbon composite. In one implementation of the method, in the synthesizing of the metal-organic composite, a molar ratio of the planarized ligand compound and the metal ions in the mixed solution is in a range of 1:0.01 to 100. In one embodiment, the molar ratio of the planarized ligand compound and the metal ions may be in a range of 1:0.01 to 100. Preferably, the molar ratio of the planarized ligand compound and the metal ion may be in a range of 1:2 to 4. The metal-carbon composite prepared by mixing the planarized ligand compound and the metal ion with each other at the molar ratio in the above range has high conductivity and high catalyst activity.

In one embodiment, in S200, the pH of the mixed solution may be in a range of 10.5 or greater.

In S400, the method may prepare the crystalline carbon layer by carbonizing the precursor powders. In one implementation of the method, the carbonizing of the precursor powders is performed for about 30 minutes to 2 hours at a temperature in a range of 700 to 1300° C. under an inert gas atmosphere.

According to the method for preparing the present disclosure, using the planarized ligand compound, the metal-carbon composite in which the crystalline carbon layer is formed on the surface of the metal powder may be prepared.

That is, the metal-carbon composite according to an embodiment of the present disclosure includes the metal powders, and the crystalline carbon layer formed on the surface of the metal powders.

In one embodiment, when the metal-carbon composite is used as an electrical catalyst, the metal-carbon composite may impart high conductivity and surface oxidation/corrosion resistance to the metal surface acting as an electrical catalyst activity point due to the presence of the crystalline carbon layer.

In one embodiment, the metal powder may include a single metal or a metal alloy, and the metal powder may include a transition metal. In one implementation of the metal-carbon composite, the metal of the metal powder includes one selected from a group consisting of titanium, vanadium, chromium, manganese, iron, cobalt, nickel, copper, zinc, zirconium, molybdenum, ruthenium, rhodium, tin, lead, palladium, silver, gold, tungsten and platinum or a metal alloy thereof. However, the present disclosure is not limited to.

In one implementation of the metal-carbon composite, a content of the crystalline carbon layer is in a range of 30 to 80 wt %, based on a total weight of the metal-carbon composite. A content of the crystalline carbon layer may be controlled by varying the molar ratio in the precursor synthesis.

In one implementation of the metal-carbon composite, a size of the metal powder may be in a range of about 10 to 200 nm. However, the present disclosure is not limited thereto. The metal powder size or distribution may be controlled by controlling the ratio between the contents of the polyphenol ligand compound and the metal ions. Further, a thickness of the crystalline carbon layer of the metal-carbon composite according to the present disclosure may be in a range of about 1 to 10 nm.

According to the present disclosure, while a coating process such as expensive vapor deposition is not performed on metal particles, the crystalline carbon layer may be formed on the surface of the metal powders via the simple carbonization process of the metal-organic precursor having controlled orientation characteristics which may be produced via a coordination bond between the planarized ligand compound synthesized via the planarization process of the polyphenol-based molecules and the metal ions. Therefore, the metal-carbon composite according to the present disclosure including the crystalline carbon layer may have maximized conductivity due to effective electron transport ability, compared to the conventional metal-carbon composite prepared via the simple physical hybridization or using the general MOF.

Further, the metal-carbon composite according to the present disclosure includes the crystalline carbon layer with relatively strong resistance to oxidation/corrosion, etc., and thus may have high stability catalyst properties, compared to a composite containing general amorphous carbon that is vulnerable to oxidation. Therefore, when being used as a catalyst for an electrolytic reaction, the metal-carbon composite according to the present disclosure exhibits high current characteristics at the same voltage, and long-term working stability against the oxidation reaction.

In addition, the method according to the present disclosure may vary the ratio between the contents of the polyphenol-based ligand compound and the metal ions in the precursor to control the metal particle size or distribution of the metal-carbon composite.

Further, according to the present disclosure, the metal particles may be formed via a spontaneous alloying process using 5 or more types of metals. Thus, in order to maximize the characteristics of the catalyst for electrolytic reaction as applied later, a type of the metal particles or the metal alloy composition may be selectively controlled.

Further, another aspect according to the present disclosure, there may be proposed a catalyst for an electrolytic reaction comprising the metal-carbon composite.

Because the metal-carbon composite according to the present disclosure has a structure in which a well-developed crystalline carbon layer is formed on the metal particle surface, the composite exhibits high transport function, high conductivity, and corrosion/oxidation related stability. Thus, the composite may be used as a catalyst for electrolytic reactions such as oxygen evolution or hydrogen evolution reaction.

Hereinafter, various Present Examples and Experimental Examples according to the present disclosure will be described in detail. However, the following Present Examples are only some examples according to the present disclosure, and the present disclosure should not be construed as being limited to the following Present Examples.

Present Example 1: Planarization Modifying Reaction Mechanism of Polyphenol-Based Ligand Compound (a) in FIG. 2 is a diagram showing a planarization modifying reaction mechanism of a polyphenol-based ligand compound; (b) in FIG. 2 is a diagram showing a structural change after carbonization of a planarization-modified tannic acid molecule according to the present disclosure and a general tannic acid.

The planarization modifying reaction mechanism of the polyphenol-based ligand compound is shown in (a) in FIG. 2.

Referring to (a) in FIG. 2, the planarization modifying reaction (modular knitting process) proceeds as two successive reactions.

1) C—C Coupling (Biarylation) Reaction

In a first step, tannic acid (TA) molecules are linked to each other via a C—C coupling reaction based on an autoxidation reaction under a basic condition of pH 10.5. Since the tannic acid (TA) is a hydrolyzable tannin, an ester group of TA may be easily hydrolyzed at the high pH. Thus, the TA molecule is dissociated into smaller units including gallic acid (GA). At the same time, these dissociated galloyl esters are subjected to oxidative crosslinking at the same pH to induce additional C—C coupling reactions in the intermediate phase composed of the hydrolyzed TA.

2) C—O Bonding (Esterification) Reaction

In a second step, this C—C coupled intermediate compound is subjected to hydrothermal treatment at 180° C. During this treatment, the hydroxyl and carboxyl groups of the galloyl unit are activated to induce the esterification reaction.

As described above, the C—C coupling and C—O coupling occur successively, such that modularized TA (hereinafter, m-TA) is produced as a repeating unit, thereby further achieving planarization-modification of m-TA into an interconnected phase with greatly increased cyclicity.

In all steps of the reaction mechanism, a total Gibbs free energy was calculated by summing the free energies, and the results are shown in Table 1 below. In this regard, the Gibbs free energy was calculated using two methods (B3LYP with D3 and wB97XD).

TABLE 1

| Model | 0 K, without frequency correction | 297.15 K, 1 atm | 453.15 K, 9.87 atm |
|---|---|---|---|
| B3LYP with D3 and PCM (solvation) | 6.58 | −25.89 | −37.32 |
| wB97XD with PCM (solvation) | 10.81 | −23.54 | −31.87 |

Further, to identify the effect of the hydrothermal reaction, the calculation was performed under two temperature/pressure conditions (ambient condition: 297.15K, and 1 atm, and high-temperature/high-pressure condition: 453.15K, and 9.9 atm).

Referring to Table 1 above, results of all calculations (except for the result at 0 K) exhibit a negative Gibbs free formation energy, thus indicating a spontaneous reaction. The Gibbs free formation energy under the high-temperature/high-pressure condition indicates a larger negative value than that at the ambient condition, thus suggesting that the hydrothermal reaction is effective in the formation of m-TA.

(a) to (c) in FIG. 3 show results of performing $^{13}C$ and $^{1}H$ nuclear magnetic resonance (NMR) and spectral characterization of FT-IR spectroscopy on reaction products (TA molecule (red), C—C coupled intermediate (orange), C—C and C—O coupled m-TA (green)) produced in a reaction mechanism step according to an embodiment of the present disclosure, respectively; (e) in FIG. 3 shows a TEM image after high-temperature carbonization of a planarized ligand compound; and (f) to (g) in FIG. 3 show a thermogravimetric analysis result, an XRD analysis result, and a Raman spectrum of each of the planarized ligand compound and Comparative Example.

Referring to (a) in FIG. 3, the C—C coupled intermediate (a-ii) exhibits distinct peaks at 118.9 and 124.9 ppm, thus indicating that carbon is located between adjacent galloyl units. This means that the biarylation reaction occurs during the first step.

Further, the C—C coupled intermediate (a-ii) exhibits a new peak at 168.8 ppm due to formation of a carboxyl group, compared with the peak located at 163.9 ppm of TA (a-i). That is, it may be identified that the biarylation reaction (C—C coupling) and the hydrolysis reaction occur simultaneously in the first step.

Further, C—C and C—O co-coupled m-TA(a-iii) exhibits a new major peak at 160.4 ppm, which is attributed to a carbonyl moiety of the ester group. It may be identified that since a residual peak remains at 168.8 ppm, all of the carboxyl or hydroxyl groups are not consumed in the esterification reaction, but unesterified functional groups partially remain.

Next, referring to (b) in FIG. 3, step-based peak change related to formation of carboxyl groups (10.8 ppm, d' in b-ii) and phenol groups (10.2 ppm, a" in b-iii) may be identified.

Similarly, regarding the characteristic peak of FT-IR analysis (in (c) in FIG. 3), C—C coupling formation corresponding to a carbonyl group of conjugated ketone is observed at 838 $cm^{-1}$ in c-ii and 1650 $cm^{-1}$ in c-iii. That is, the planarized ligand compound (m-TA) according to the present disclosure exhibits a highly interconnected aromatic molecular structure due to the simultaneous formation of the C—C coupling and the C—O coupling.

Present Example 2: Structural Characteristics of Planarized Ligand Compound

Referring to (b) in FIG. 2, unlike a 3D bundled isotropic molecular structure of the general tannic acid (TA), the planarized ligand compound (hereinafter, referred to as m-TA molecule) according to an embodiment of the present disclosure maintains a 2D planarized structure of a carbon frame. This interconnected structure may induce planarized stacking of carbon layers during the carbonization to form graphitized carbon.

To identify this induction, the m-TA is subjected to carbonization at a high temperature of 2000° C., and then a TEM image thereof is taken. The image is shown in (e) FIG. 3.

Referring to (e) in FIG. 3, it may be clearly identified that 10 to 15 layers made of graphitic carbon are vertically stacked by a domain spacing in a range of 20 to 30 nm.

Further, thermogravimetric analysis (TGA) is performed to identify the thermal stability of m-TA under pyrolytic carbonization. The analysis result is shown in (f) in FIG. 3. As a result, it is identified that when using tannic acid (bare TA), only 18% of the carbon remains after pyrolysis under $N_2$, whereas when using the m-TA, the residual carbon content increases significantly to a maximum of 42%, thereby indicating efficiency of the m-TA related to the post-treatment.

Further, to compare the pyrolytic carbons respectively derived from TA and m-TA with each other, a graphitization amount and phase information are investigated using XRD and Raman spectroscopy, and results are shown in (g) and (b) FIG. 3. In this regard, structural properties are analyzed compared to those of unpyrolyzed graphite.

In (g) in FIG. 3 showing the XRD result, graphite exhibits a sharp crystalline peak at 26.41°, whereas carbonized bare TA exhibits discontinuous broad peaks, which is a typical behavior of hard carbon. In the carbonized in-TA, a relatively narrow peak at 26.21° appears due to the improved crystallinity of the carbonized domain of m-TA.

This subtle position shift compared to the crystalline peak of graphite is due to increase in a spacing between the graphite carbon layers in the carbonized m-TA.

Based on the Raman spectrum of (h) in FIG. 3, a $I_D/I_G$ ratio of graphite is estimated to be 0.167, which is the lowest among values of carbon samples due to the essentially greatly expanded $sp^2$ domain. In the bare TA, a slight 2D band (about 2680 $cm^1$) appears due to the very high carbonization temperature of 2000° C. However, a red-shifted 2D band related to the bare TA is associated with formation of a stack of few layers of graphene at extremely high pyrolysis temperature, and proliferation of high-defect carbon was clearly identified based on a higher $I_D/I_G$ ratio of 1.503.

In contrast, regarding the carbonized m-TA, formation of a stack of a larger number of layers made of graphite carbon is identified. In this regard, a strong 2D band and a significantly reduced $I_D/I_G$ ratio of 0.718 are measured. That is, the planarized molecular structure of the m-TA successfully exhibits a similar behavior to that of graphite soft carbon.

Present Example 3: Preparing of Metal-Carbon Composite

A small amount of ammonia solution was added to a solution in which the planarized ligand compound as prepared in Present Example 1 and metal ions of two types of metals selected among Fe, Co and Ni metal were mixed with each other in a molar ratio of 1:3. Then, pH of the mixed solution was adjusted to 10.5 or greater. Thereafter, the mixed solution was put into an autoclave reactor and then hydrothermal synthesis was carried out thereon in an oven at 180° C. or higher for 12 hours or larger.

After the hydrothermal synthesis, the thus-obtained solution was subjected to centrifugation at 11000 rpm for 10 minutes. Then, a supernatant was removed therefrom to obtain the organic-metal composite. Then, the organic-metal composite was sufficiently dried in an oven at 70° C. for 12 hours or larger.

Thereafter, the obtained precursor powders were carbonized at 900° C. for 2 hours under an inert gas (argon gas) atmosphere to prepare metal-carbon composite powders.

Present Example 4: Characteristics of Metal-Carbon Composite Containing Bimetallic Alloy FIGS. 4 and 5 show a TEM image and an EDS mapping image of a metal-carbon composite containing a bimetal alloy containing two metals among Fe, Co and Ni, and show a metal particle size and a carbon layer thickness based on a molar ratio of the metal and the planar ligand compound.

Referring to FIGS. 4 (left) and 5, NiFe bimetallic alloy nanoparticles are surrounded with a stack of multiple graphitic carbon shell layers. This metal core/carbon-shell structure is also observed in each of other composites respectively containing other CoNi and FeCo alloys.

Further, referring to FIG. 4 (right), it may be identified that the metal particle size of the metal-carbon composite containing the bimetallic alloy depends on the molar ratio of the ligand compound and the metal ions. Further, it may be identified that the sizes of the metal particles are relatively uniform. Moreover, it is identified that a thickness of the crystalline carbon layer is controlled to be in a range of about 1 to 10 nm.

Moreover, in order to identify the OER (oxygen evolution reaction) catalyst activity based on the type of the bimetallic alloy, a DFT of each of the metal-carbon composites was calculated and a calculation result is shown in FIG. 5. The DFT calculation was performed on a single graphitic carbon layer placed on a specific structure of a crystal plane. In this case, a possible adsorption site was defined to estimate an adsorption energy related to each of various catalysts. Using this predefined adsorption site, a reaction energy related to each of reaction intermediates was calculated. In this regard, we assumed that the reaction intermediate can freely migrate to other adsorption sites to minimize overpotential during the oxygen evolution reaction (OER).

FIG. 6 shows a Gibbs free energy profile of each of NiFe/C catalyst, FeCo/C catalyst, and CoNi/C catalyst on each reaction intermediate during OER at different constant potentials.

Referring to FIG. 6, most of the reaction steps are endothermic at equilibrium potentials of 0 and 1.23 V, while all reaction steps are exothermic with an applied potential of 2.75 V. The Gibbs free energy profile of each of the CoNi/C catalyst and the FeCo/C catalyst also exhibits a similar result thereto.

Present Example 5: Characteristics of Catalyst for Water Electrolysis Comprising Metal-Carbon Composite Electrical catalyst activity on the oxygen evolution reaction (OER) of Ni metal-carbon composite prepared while the molar ratio of the metal ion and the ligand compound is controlled to each of 10:1, 3:1, 1:1, 1:3, and 1:10 is identified, and the activity results are shown in FIG. 7.

FIG. 7 shows a measurement result based on a LSV (Linear Sweep Voltammetry) as an oxygen evolution reaction test result of a metal/carbon composite according to the present disclosure based on a molar ratio of a metal and a planar ligand compound. As shown in FIG. 7, when the Ni metal-carbon composite prepared at the molar ratio of the metal ion and the ligand compound is 3:1 is used, the best catalyst activity is realized.

Present Example 6: Evaluation of Activity Catalyst for Water Electrolysis Comprising Metal-Carbon Composite Containing Bimetallic Alloy The oxygen evolution (OER) related electrocatalytic performance of each of a metal-carbon composite catalyst according to an embodiment of the present disclosure and a reference material (that is, $IrO_2$) was evaluated using a standard three-electrode system immersed in 1M KOH electrolyte. Specifically, the catalyst activity was measured based on linear sweep voltammetry (LSV, 95% iR-compensated, 5 mV $s^{-1}$ scan rate) (see (a) in FIG. 8).

FIG. 8 shows a measurement result (left) based on the LSV (Linear Sweep Voltammetry), an overpotential/Tafel slope comparison (middle), and an overpotential/Tafel slope comparison schematic diagram (right) compared with other references, as an oxygen evolution reaction test result of a bimetal-based metal/carbon composite synthesized according to an embodiment of the present disclosure.

At a current density of 10 mA $cm^2$, the NiFe/C catalyst exhibited lower overpotential value (Z=260 mV) compared to that of each of the CoNi/C catalyst (Z=279 mV), the FeCo/C catalyst (Z=299 mV), and the reference material ($IrO_2$) catalyst (Z=322 mV).

A Tafel plot was created together with the overpotential, and a graph showing overpotential/Tafel slope comparison is shown in (b) in FIG. 8.

In the Tafel plot, NiFe/C catalyst exhibited the smallest slope value (43.2 mV dec-1), compared with that of each of CoNi/C catalyst (50.8 mV dec-1), FeCo/C catalyst (64.0 mV dec-1) and $IrO_2$ (74.6 mV dec-1), thus indicating that the NiFe/C catalyst exhibited significantly accelerated oxygen evolution (OER)-related catalyst activity.

Further, (c) in FIG. 8 is a Tafel plot/overpotential comparison graph showing performance of each of the catalyst according to an embodiment of the present disclosure and a known material. Referring to (c) in FIG. 8, it may be identified that the metal-carbon composite catalyst according to the embodiment of the present disclosure exhibits significantly lowered overpotential and Tafel slope.

Thus, the metal-carbon composite catalyst (NiFe/C catalyst) according to the embodiment of the present disclosure may be used as a very efficient activity material supporting matrix pair for the oxygen evolution reaction (OER) in an alkaline medium, compared to other Comparative Examples (graphene or other bimetallic alloy with carbon support).

Similarly, the hydrogen evolution rection (HER) related electrocatalyst performance was evaluated, compared to that of Pt/C catalyst (see FIG. 9).

FIG. 9 shows a measurement result (top left) based on the LSV (Linear Sweep Voltammetry), a Tafel schematic diagram (top right), an overpotential and Tafel slope comparison (bottom left), and a comparison schematic diagram of a theoretical adsorption energy of hydrogen ions (bottom right) as a hydrogen evolution reaction test result of a bimetal-based metal/carbon composite synthesized according to an embodiment of the present disclosure.

Referring to FIG. 9, FeCo/C catalyst exhibits lower overpotential (Z=84 mV) compared to that of each of CoNi/C catalyst (Z=93 mV) or NiFe/C catalyst (Z=108 mV).

FIG. 10 is a graph showing performance measurement of an alkaline anion exchange membrane water electrolyzer in which a metal-carbon composite according to the present disclosure is applied as an anode of the alkaline anion exchange membrane water electrolyzer. A red color shows that when using a polynorbornene separation membrane, and a blue color shows that when using a polyphenylene separation membrane. An anode of the electrolyzer was made of the NiFe/C catalyst according to the present disclosure, and a cathode thereof was made of a commercial PtRu/C material. The electrolyzer operated in electrolyte at 80° C. and made of 1M NaOH. Specifically, the catalyst activity was measured based on linear sweep voltammetry (LSV, 95% iR-compensated, 5 mV $s^{-1}$ scan rate).

Referring to FIG. 10, the NiFe/C catalyst exhibited current densities of 2.38 and 2.61 A/$cm^2$ based on a 2.0V cell potential, and exhibited catalyst performance reproducible in two experiments.

FIG. 11 is a graph illustrating long-term operation stability of an alkaline anion exchange membrane water electrolyzer in which a NiFe/C composite synthesized in accordance with the present disclosure is applied as an anode of the alkaline anion exchange membrane water electrolyzer. The stability of the catalyst according to the present disclosure was evaluated based on chronopotentiometry under application of a current density of 200 mA/$cm^2$.

As shown in FIG. 11, only about 0.06 V of voltage rise occurs under an operation condition of about 10 hours (36,000 seconds). Thus, it may be identified that the crystalline carbon on the metal particle surface of the catalyst in accordance with the present disclosure has excellent corrosion-against stability in a strong base environment, compared to that of each of other catalysts including amorphous carbon.

Present Example 7: Characteristics of Metal-Carbon Composite Containing Alloy Composed of 5 Types of Metals FIG. 12A shows a TEM image and an EDS mapping image of a metal-carbon composite containing a five metal alloy composed of Fe, Co, Ni, Mn and Cu.

FIG. 12B shows an XRD data of a metal-carbon composite containing a five metal alloy composed of Fe, Co, Ni, Mn and Cu.

Referring to FIG. 12A, it may be observed that the five types of metals form metal particles via a spontaneous alloying process. Further, it may be identified that the metal particles are surrounded with a stack of multiple graphitic carbon shell layers.

Further, referring to FIG. 12B, a crystallinity peak at 26.2° corresponds to a graphitic carbon crystal phase surrounding the metal particle, while remaining 43.5°, 50.6°, and 74.4° are related to peaks of a FCC crystal phase of the alloy of the five types of metals and correspond to (111), (200), and (220) planes. respectively. Therefore, it may be identified that an alloy phase constituting the FCC crystal phase is well formed.

The descriptions of the presented embodiments have been provided so that a person of ordinary skill in the art of any the present disclosure may use or practice the present disclosure. Various modifications to these embodiments will be apparent to those skilled in the art of the present disclosure, and the general principles defined herein may be applied to other embodiments without departing from the scope of the present disclosure. Thus, the present disclosure is not intended to be limited to the embodiments presented herein, but is to be construed in the widest scope consistent with the principles and novel features presented herein.

What is claimed is:

1. A method for preparing a metal-carbon composite, the method comprising:

synthesizing a planarized ligand compound via planarization-modification of a polyphenol-based ligand compound;

synthesizing a metal-organic composite via hydrothermal synthesis of a mixed solution of the planarized ligand compound and metal ions;

drying the metal-organic composite to prepare precursor powders; and carbonizing the precursor powders, wherein the planarized ligand compound has a plate-like structure.

2. The method of claim 1, wherein the polyphenol-based ligand compound includes at least one selected from the group consisting of A compounds respectively represented by following Chemical Formulas:

[Chemical Formula 1-1]

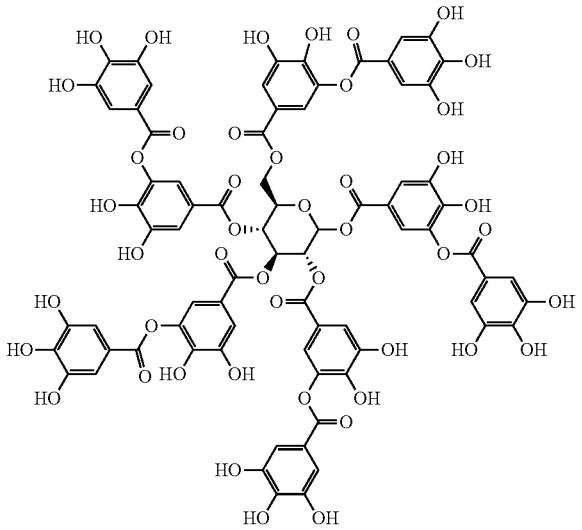

[Chemical Formula 1-2]

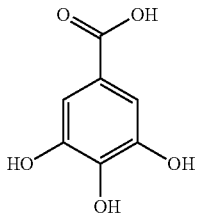

[Chemical Formula 1-3]

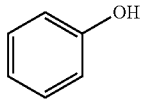

Phenol, mono-phenol

[Chemical Formula 1-4]

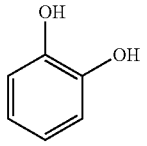

Catechol, di-phenol

-continued

[Chemical Formula 1-5]

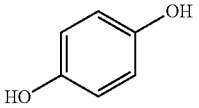

Hydroquinone, di-phenol

[Chemical Formula 1-6]

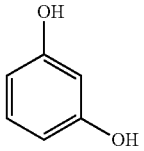

Resorcinol, di-phenol

[Chemical Formula 1-7]

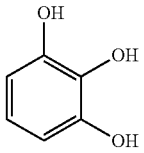

Gallocatechol, tri-phenol

[Chemical Formula 1-8]

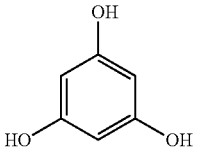

Phloroglucinol, tri-phenol

[Chemical Formula 1-9]

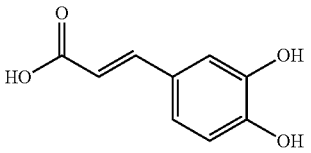

Caffeic acid

[Chemical Formula 1-10]

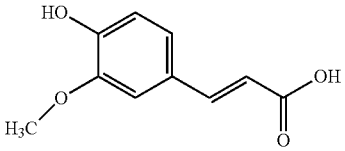

Ferulic acid

[Chemical Formula 1-11]

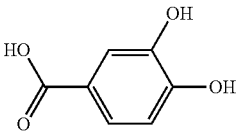

Protocatechuic acid

[Chemical Formula 1-12]

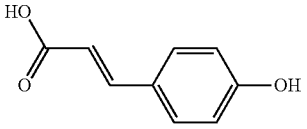

Coumaric acid

[Chemical Formula 1-13]

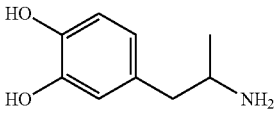

L-DOPA

-continued

[Chemical Formula 1-14]

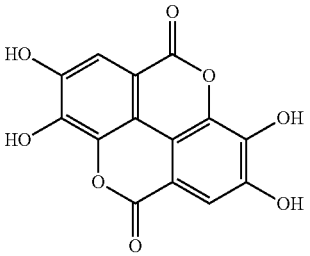

Ellagic acid

[Chemical Formula 1-15]

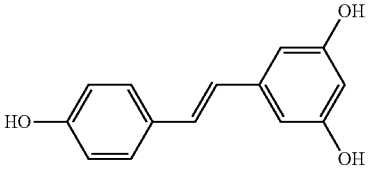

Resveratrol

[Chemical Formula 1-16]

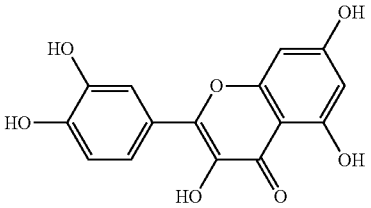

Quercetin

[Chemical Formula 1-17]

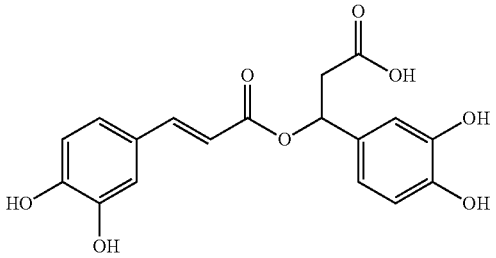

Rosmarinic acid

[Chemical Formula 1-18]

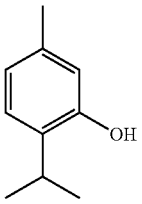

Thymol

[Chemical Formula 1-19]

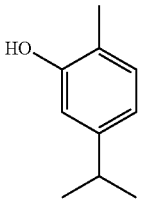

Carvacrol

-continued

[Chemical Formula 1-20]

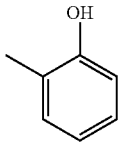

o-Cresol

[Chemical Formula 1-21]

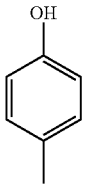

p-Cresol

[Chemical Formula 1-22]

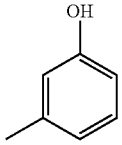

m-Cresol

[Chemical Formula 1-23]

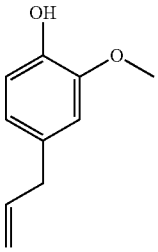

Eugenol

[Chemical Formula 1-24]

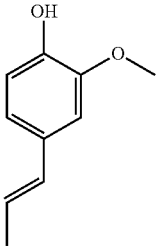

Isoeugenol

[Chemical Formula 1-25]

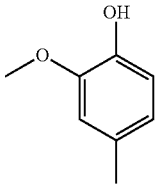

Creosol

-continued

[Chemical Formula 1-26]

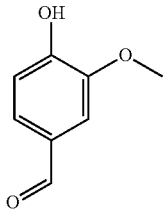

Vanillin

[Chemical Formula 1-27]

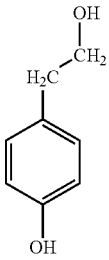

Tyrosol

[Chemical Formula 1-28]

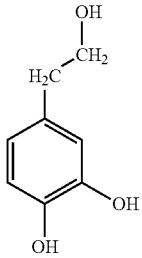

Hyroxytyrosol

[Chemical Formula 1-29]

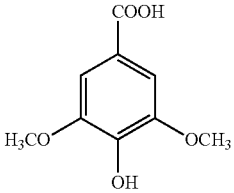

Syringic acid

[Chemical Formula 1-30]

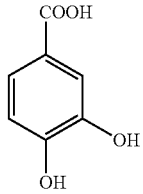

protocatechuic acid

[Chemical Formula 1-31]

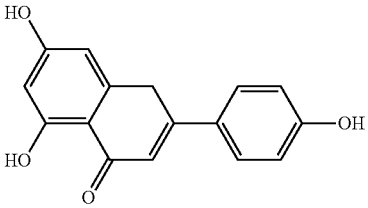

Apigenin

-continued
[Chemical Formula 1-32]
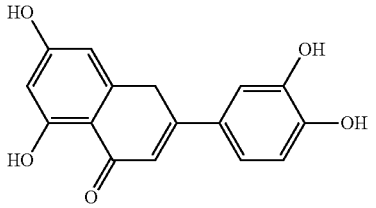
Luteolin
[Chemical Formula 1-33]
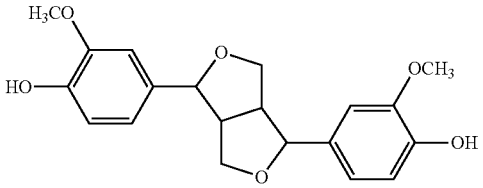
Pionoresinol
[Chemical Formula 1-34]
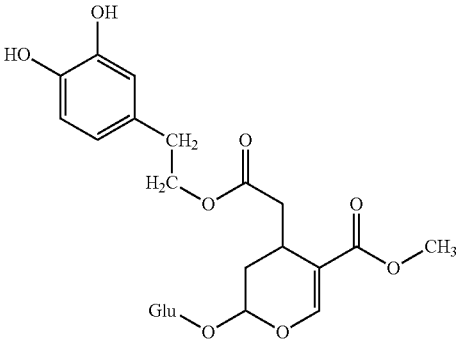
Oleuropein
[Chemical Formula 1-35]
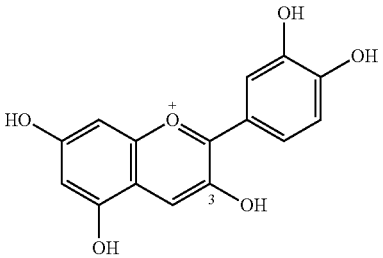
[Chemical Formula 1-36]
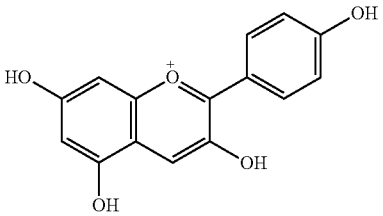
[Chemical Formula 1-37]
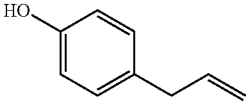
-continued
[Chemical Formula 1-38]
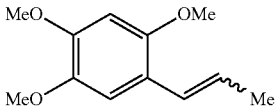
[Chemical Formula 1-39]
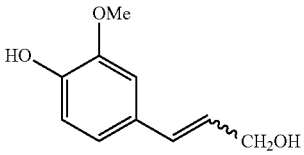
[Chemical Formula 1-40]
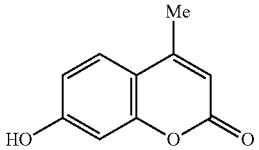
[Chemical Formula 1-41]
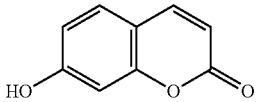
[Chemical Formula 1-42]
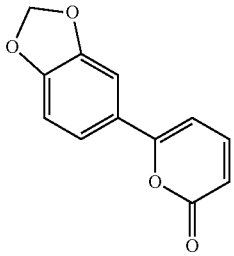
[Chemical Formula 1-43]
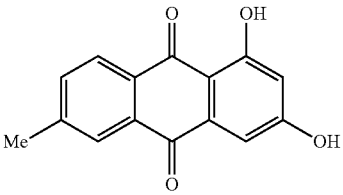
[Chemical Formula 1-44]
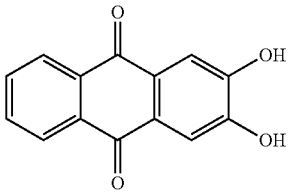
[Chemical Formula 1-45]
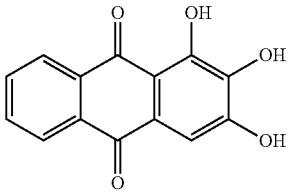
[Chemical Formula 1-46]
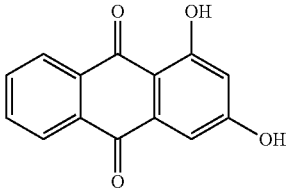

-continued
[Chemical Formula 1-47]
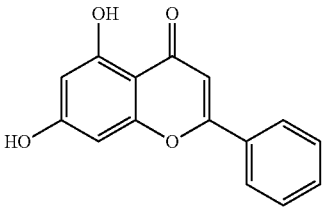
[Chemical Formula 1-48]
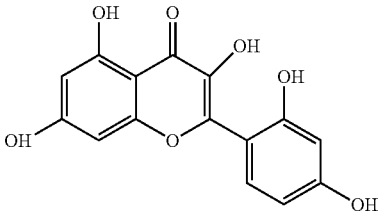
[Chemical Formula 1-49]
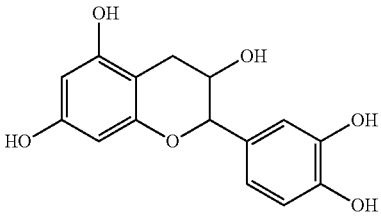
[Chemical Formula 1-50]
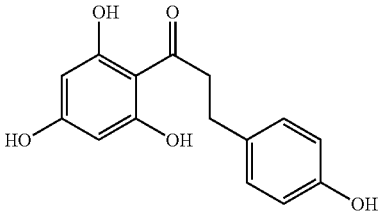
[Chemical Formula 1-51]
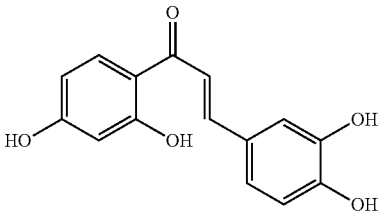
[Chemical Formula 1-52]
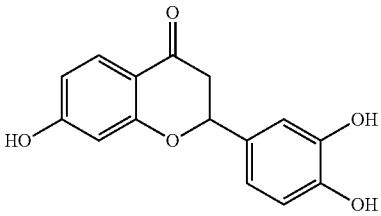
-continued
(a)
[Chemical Formula 1-53]
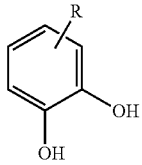
$R = R^{15.0}, R^{15.1}, R^{15.2}$ or $R^{15.3}$
(b)
[Chemical Formula 1-54]
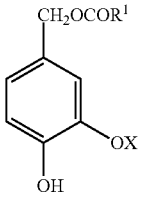
$R^1 = R^{17.2}$ or $R^{17.3}$
$X = H$ or $CH_3$
(c)
[Chemical Formula 1-55]
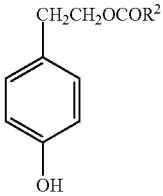
$R^2 = R^{17.2}$ or $R^{17.3}$
(d)
[Chemical Formula 1-56]
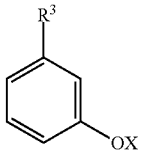
$R^3 =$ $R^{15.0}$ (3%)
$R^{15.1}$ (34%)
$R^{15.2}$ (22%)
$R^{15.3}$ (41%)
$R^{17.2}$
$R^{17.3}$
$R^{15.0}$
$R^{15.1}$
$R^{15.2}$
$R^{15.3}$ -continued

[Chemical Formula 1-57]

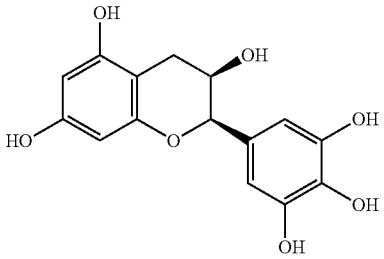

Epigallocatechin (EGC)

[Chemical Formula 1-58]

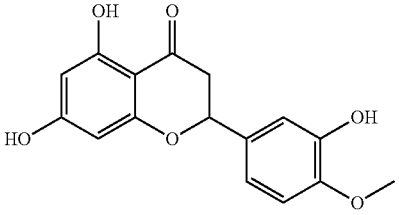

Hesperetin

[Chemical Formula 1-59]

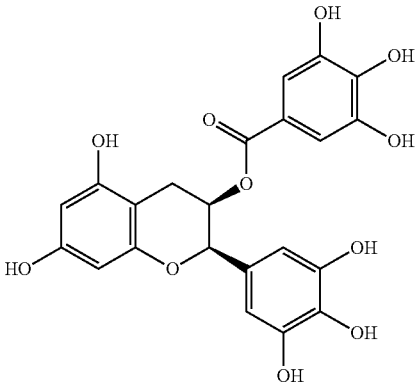

Epigallocatechin Gallate (EGCG)

[Chemical Formula 1-60]

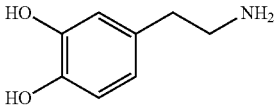

Dopamine

[Chemical Formula 1-61]

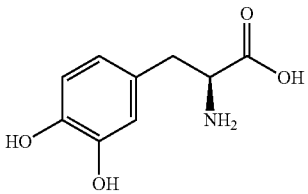

-continued

[Chemical Formula 1-62]

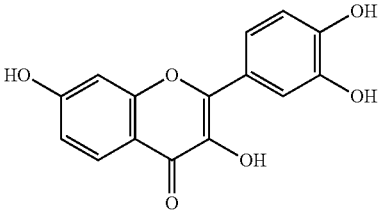

[Chemical Formula 1-63]

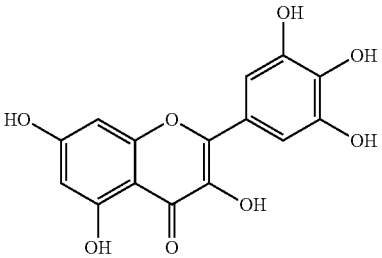

[Chemical Formula 1-64]

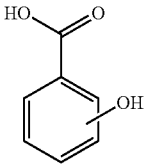

hydroxybenzoic acid

[Chemical Formula 1-65]

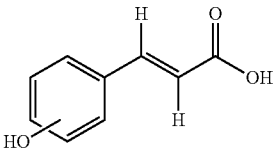

hydroxycinnamic acid

[Chemical Formula 1-66]

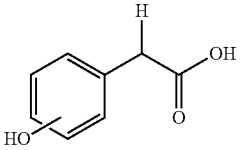

hydroxyphenylacetic acid

[Chemical Formula 1-67]

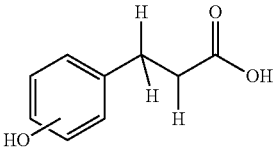

hydroxyphenylpropanoic acid

[Chemical Formula 1-68]

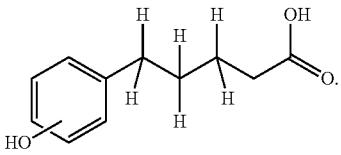

hydroxyphenylpentanoic acid

3. The method of claim 1, wherein synthesizing the planarized ligand compound includes:

treating the polyphenol-based ligand compound with a basic substance to induce a C—C coupling reaction between phenol molecules to prepare an intermediate compound; and performing hydrothermal treatment of the intermediate compound to induce an esterification reaction.

4. The method of claim 1, wherein in the synthesizing of the metal-organic composite, the hydrothermal synthesis is performed at a temperature in a range of 100 to 200° C. for about 6 to 24 hours.

5. The method of claim 1, wherein a metal of the metal ion includes at least one selected from the group consisting of titanium, vanadium, chromium, manganese, iron, cobalt, nickel, copper, zinc, zirconium, molybdenum, ruthenium, rhodium, tin, lead, palladium, silver, gold, tungsten and platinum.

6. The method of claim 1, wherein in the synthesizing of the metal-organic composite, a molar ratio of the planarized ligand compound and the metal ions in the mixed solution is in a range of 1:0.01 to 100.

7. The method of claim 1, wherein in the synthesizing of the metal-organic composite, pH of the mixed solution is equal to or greater than 10.5.

8. The method of claim 1, wherein the carbonizing of the precursor powders is performed for about 30 minutes to 2 hours at a temperature in a range of 700 to 1300° C. under an inert gas atmosphere.

9. A metal-carbon composite prepared using the method according to claim 1, wherein the metal-carbon composite comprises metal powders; and a crystalline carbon layer formed on a surface of the metal powders.

10. The metal-carbon composite of claim 9, wherein a metal of the metal powder includes a single metal or a metal alloy.

11. The metal-carbon composite of claim 10, wherein the metal of the metal powder includes one selected from the group consisting of titanium, vanadium, chromium, manganese, iron, cobalt, nickel, copper, zinc, zirconium, molybdenum, ruthenium, rhodium, tin, lead, palladium, silver, gold, tungsten, platinum, and alloys thereof.

12. The metal-carbon composite of claim 9, wherein a content of the crystalline carbon layer is in a range of 30 to 80 wt %, based on a total weight of the metal-carbon composite.

13. The metal-carbon composite of claim 9, wherein a size of the metal powder is in a range of about 10 to 200 nm.

14. The metal-carbon composite of claim 9, wherein the crystalline carbon layer has a thickness in a range of about 1 to 10 nm.

15. A catalyst for electrolytic reaction comprising the metal-carbon composite according to claim 9.

* * * * *